US009685145B2

(12) United States Patent
Seal

(10) Patent No.: US 9,685,145 B2
(45) Date of Patent: Jun. 20, 2017

(54) CARBON FIBER GUITAR

(71) Applicant: MCP IP, LLC, Sparta, WI (US)

(72) Inventor: Ellis C. Seal, Bay Saint Louis, MS (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 14/924,291

(22) Filed: Oct. 27, 2015

(65) Prior Publication Data

US 2016/0063968 A1 Mar. 3, 2016

Related U.S. Application Data

(63) Continuation of application No. 14/090,479, filed on Nov. 26, 2013, now Pat. No. 9,171,528.

(60) Provisional application No. 61/730,181, filed on Nov. 27, 2012.

(51) Int. Cl.

| | |
|---|---|
| ***G10D 3/02*** | (2006.01) |
| ***G10D 1/08*** | (2006.01) |
| ***G10D 1/00*** | (2006.01) |
| ***G10D 3/06*** | (2006.01) |
| ***G10D 3/04*** | (2006.01) |

(52) U.S. Cl.

CPC ..... *G10D 3/02* (2013.01); *G10D 1/005* (2013.01); *G10D 1/08* (2013.01); *G10D 3/04* (2013.01); *G10D 3/06* (2013.01)

(58) Field of Classification Search

CPC ..... G10D 3/04; G10D 1/08

See application file for complete search history.

(56) References Cited

U.S. PATENT DOCUMENTS

| | | | | |
|---|---|---|---|---|
| 1,818,631 | A * | 8/1931 | Larson | G10D 3/06 84/293 |
| 3,196,730 | A | 7/1965 | Daniel | |
| 4,200,023 | A * | 4/1980 | Kaman | G10D 3/06 84/293 |
| 4,432,267 | A | 2/1984 | Feller | |
| 4,950,437 | A * | 8/1990 | Lieber | B29C 70/462 156/191 |
| 5,018,423 | A | 5/1991 | Bunker et al. | |
| 5,233,122 | A * | 8/1993 | Kim | G10D 3/06 84/293 |
| 5,421,233 | A | 6/1995 | Bunker | |
| 5,644,094 | A * | 7/1997 | Dickson, II | G10D 3/04 84/298 |
| 5,689,075 | A | 11/1997 | Rose | |
| 6,051,766 | A | 4/2000 | Taylor | |

(Continued)

*Primary Examiner* — Robert W Horn

(57) ABSTRACT

A stringed musical instrument has a molded sound box and neck where the sound box is formed of between 20% to 60% carbon fibers, or other suitable fibers, and a polymeric resin or binder. The composition of materials utilized in the sound box is selected to increase stiffness and to control the tone of the instrument. The sound box includes an adjustable attachment mechanism having a pivot which is used to secure the neck to the sound box. The sound box includes a molded bracing structure having a plurality of braces and a molded bridge having a plurality of pockets which are used to enhance the structure for the sound box and provide a desired tone quality for the stringed instrument. The neck may include a molded neck insert and a molded fingerboard which are used to enhance the stiffness and stability of the neck.

20 Claims, 5 Drawing Sheets

(56) References Cited

U.S. PATENT DOCUMENTS 6,060,650 A 5/2000 McPherson
6,087,568 A * 7/2000 Seal ..... G10D 1/005 84/193
6,100,458 A * 8/2000 Carrington ..... G10D 1/005 84/267
6,103,961 A * 8/2000 Kaufman ..... G10D 1/08 84/291
6,124,536 A 9/2000 Hoshino
D432,158 S * 10/2000 Gregory ..... D17/20
6,194,645 B1 2/2001 Rose
6,265,648 B1 7/2001 Steinberger
6,376,756 B1 * 4/2002 Beckmeier ..... G10D 3/06 84/293
6,426,454 B1 * 7/2002 Gregory ..... G10D 1/00 84/267
6,657,113 B2 * 12/2003 Herman ..... G10D 3/06 84/293
6,774,292 B2 8/2004 Mace
6,822,147 B2 11/2004 McPherson
6,888,055 B2 5/2005 Smith et al.
6,965,065 B2 * 11/2005 McPherson ..... G10D 3/06 84/293
7,157,634 B1 * 1/2007 Babicz ..... G10D 3/06 84/267
7,276,868 B2 * 10/2007 Allred, III ..... G10D 3/02 318/294
7,342,161 B1 * 3/2008 Fox ..... G10D 3/06 84/193
7,465,859 B2 12/2008 Kroeger et al.
7,531,729 B1 5/2009 Davis et al.
7,612,271 B1 * 11/2009 Davis ..... G10D 3/02 84/267
7,687,698 B2 3/2010 Kim
7,763,786 B2 * 7/2010 Jones ..... G10D 3/06 84/314 R
7,786,361 B1 * 8/2010 Foltz ..... G10D 1/005 84/267
7,795,513 B2 * 9/2010 Luttwak ..... G10D 1/00 84/267
7,816,592 B2 * 10/2010 Babicz ..... G10D 3/06 84/267
RE43,075 E 1/2012 Kroeger et al.
8,389,837 B1 * 3/2013 Leguia ..... G10D 1/08 84/267
8,450,587 B2 5/2013 McPherson
9,012,750 B2 * 4/2015 Berndt ..... G10D 3/06 84/293
9,171,528 B2 * 10/2015 Seal ..... G10D 1/005
2002/0005105 A1 1/2002 McPherson
2002/0174760 A1 * 11/2002 Mace ..... G10D 3/06 84/293
2006/0042449 A1 3/2006 Chang
2007/0107579 A1 * 5/2007 Babicz ..... G10D 3/06 84/293
2008/0190264 A1 8/2008 Jones et al.
2012/0192698 A1 8/2012 Allred et al.
2014/0144306 A1 * 5/2014 Seal ..... G10D 1/005 84/291
2014/0298970 A1 * 10/2014 Allred, III ..... G10D 3/06 84/293
2015/0101473 A1 4/2015 Seal
2015/0317958 A1 * 11/2015 McSwain ..... G10D 3/06 84/293
2016/0063968 A1 * 3/2016 Seal ..... G10D 1/005 84/291

* cited by examiner

CARBON FIBER GUITAR

CROSS REFERENCE TO RELATED APPLICATIONS

This application is a continuation of U.S. patent application Ser. No. 14/090,479, filed Nov. 26, 2013, now U.S. Pat. No. 9,171,528, which claims the benefit of provisional patent application Ser. No. 61/730,181 filed on Nov. 27, 2012, the entire disclosures of which are hereby incorporated herein by reference.

FIELD OF THE INVENTION

The invention, in at least one embodiment, is directed to stringed musical instruments which include guitars, and more specifically to structural features that make instruments stronger, easier to manufacture and/or sound better.

The present invention relates to a guitar or other stringed musical instrument having a sound box, and more particularly, the present invention relates to a unique sound box, soundboard, bracing structure, bridge, neck, and other parts, for the stringed musical instrument, where the various parts may be formed of carbon or other suitable fibers.

BACKGROUND OF THE INVENTION

Guitars are one example of stringed musical instruments. Carbon fiber has been used in various portions of stringed instruments since the 1970s. In the past, the bodies of the stringed instrument have been formed of carbon fiber laminates which are generally stiff and light, however fiber laminates do not generally have the acoustic characteristics desired by those who are used to the sound of wood. The natural acoustic characteristics of carbon laminates cause the instrument to tend to sound metallic, and lack the warmth of wood. In addition, solid carbon fiber laminates have a higher density as compared to wood, and for a given weight, have significantly lower bending stiffness. Therefore using carbon fiber in the design of portions of stringed instrument in order to provide a desired acoustic response, tone, and feel of wood, is a challenge.

In the past, carbon fiber instrument builders have used continuous, long fiber reinforced materials to make the instruments. Manufacturing with these materials has been very costly, using high cost raw materials and requiring labor intensive meticulous human craftsmanship in the laminating process. This is particularly true in making the instrument sound box or body, or portion of the instrument to which the soundboard is attached, which is primarily for containing a volume of air to allow the creation of a Helmholtz resonator.

In the past, stringed musical instruments have been made from injection molded plastics. Due to the inferior structural and sonic response of these materials, these instruments are generally not preferred by most musicians.

Many different variations of wood and carbon fiber have been attempted in order to provide an acceptable level of performance with respect to vibration, structural integrity, acoustic response, tone, and feel for a stringed instrument. The use of alternative materials in the formation of sound boxes or soundboards, in many instances, has resulted in an instrument which is over damped. In addition, in many instances where carbon or other materials have been used in the formation of the soundboard or sound box, the soundboard or sound box is overly thin, causing the instrument to be prone to damage upon exposure to minor impacts.

A typical acoustic guitar has a hollow body or sound box connected to a neck. A soundboard with a sound hole is attached to the sound box. A back or bottom board is spaced from the soundboard, and a shaped side wall extends between the soundboard and backboard.

A stringed musical instrument has a series of strings strung at substantial tension from a bridge on the soundboard, across the soundboard proximate to a sound hole, and along the neck. The string tension creates forces which act on the soundboard and which, over time, may cause bending, cracking or other damage to the soundboard. The damage can result in structural failure and altered intonation of the stringed musical instrument. As such, the sound box, must be constructed in a relatively strong and stable manner, without making it to heavy, or limiting its response.

In high quality stringed musical instruments, the soundboard must be capable of vibration to provide superior acoustic performance while being rigid so that it withstands the forces created by the tensioned strings. These requirements are at cross-purposes, and have been very difficult to achieve, particularly when the soundboard is constructed from a material other than choice wooden materials.

Stringed musical instruments are also constructed so as to amplify the sound wave produced by the vibration of the strings, via a resonance body. The sound wave created by the vibrating strings is introduced into the resonance body through the bridge provided on the soundboard. Inside the resonance body, the sound wave is resounded and amplified. If the resonance body is not constructed correctly, the sound may be emitted in a muffled or dampened manner.

The present invention provides for uniformity in the construction of a stringed instrument, which in conjunction with the sound box delivers clean, brilliant sound. The construction of the stringed instrument provides for easier and more economical manufacture when state of the art equipment is used.

Generally, a relationship is present in a stringed musical instrument between the mass of the soundboard and the vibration of strings. Generally, the higher the mass of the soundboard (assuming constant stiffness), the lower the amplitude of vibration from a given string input. The lower the amplitude of vibration produced by the soundboard, the lower the volume of the instrument. Also, mass in the soundboard reduces sustain; for a higher mass, more energy is dissipated in every vibration cycle, and the string energy, soundboard vibration, and volume decrease faster resulting in less sustain.

All U.S. patents and applications all other published documents mentioned anywhere in this application are incorporated herein by reference in their entireties. Without limiting the scope of the invention in any way, the invention is briefly summarized in some of its aspects below.

The art referred to and/or described above is not intended to constitute an admission that any patent, publication or other information referred to herein is "prior art" with respect to this invention.

BRIEF SUMMARY OF THE INVENTION

Figure 1:
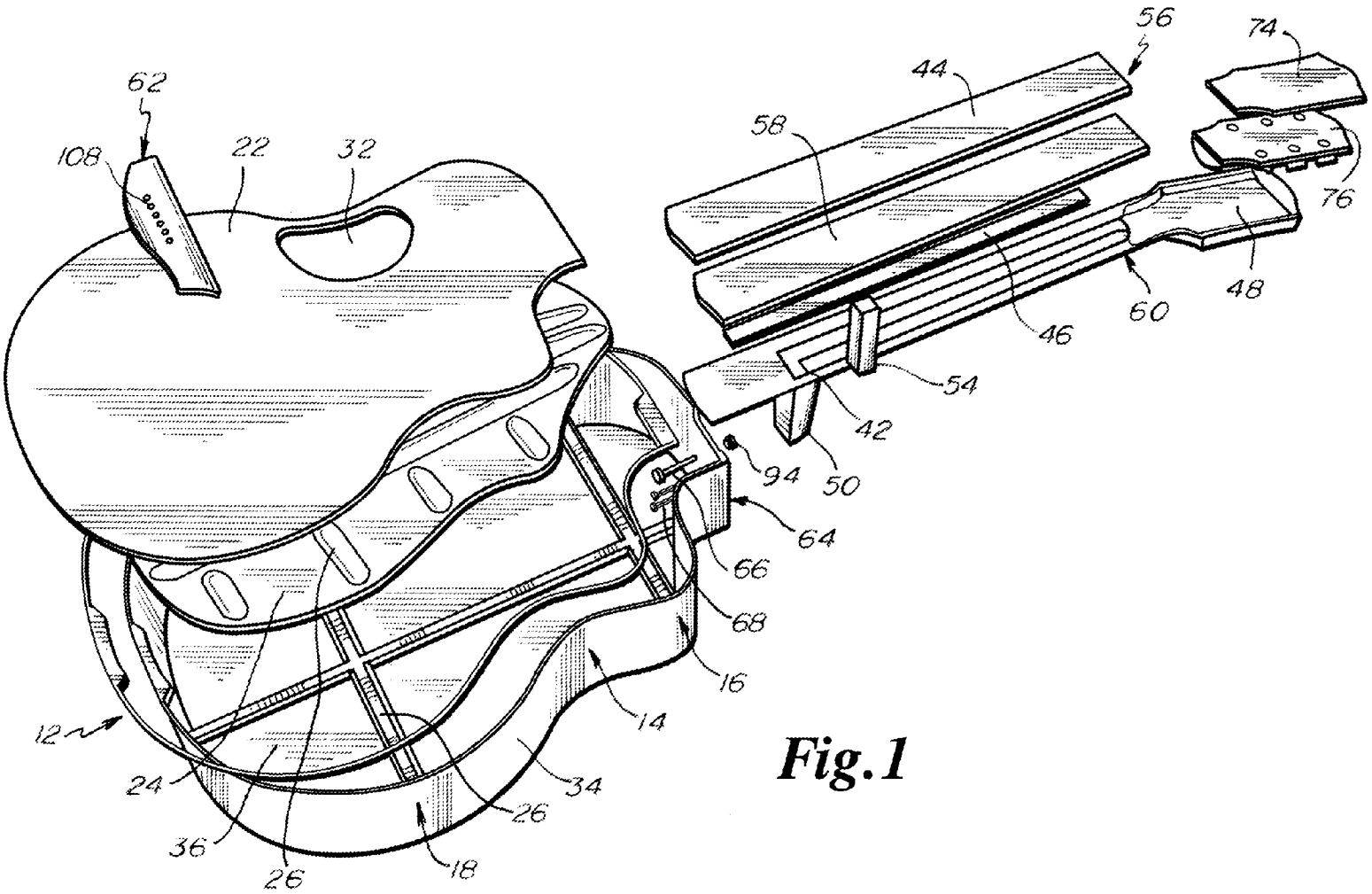
FIG. 1 is an exploded isometric view of one alternative embodiment of a stringed musical instrument.

In one embodiment, the invention is directed to the use of materials which provide significant cost savings during the manufacture of stringed musical instruments. Specifically, this invention in at least one embodiment is directed to the use of short, discontinuous carbon, fiber or other suitable fiber composites for stringed musical instrument sound boxes. The term "composite" here is used to describe a mixture of a reinforcing fiber and a polymeric matrix or binder that holds the reinforcing fibers in place and causes the fibers to act or function together, to provide a desired acoustic response.

In some embodiments, the invention is also directed to a method of manufacture, whereby the fiber composites are molded using a mold or die that forms both inner and outer surfaces for the elements of the stringed musical instrument and particularly the sound box.

In some embodiments, the length of carbon fiber or other suitable fiber is from 0.005" to 1.0"—which allows for the material to maintain some of the stiffness characteristics of the carbon fiber, or other suitable fiber, in the performance of the final composite. In general, the longer the fiber, the better the performance. In other embodiments, the fibers may be shorter than 0.005" and longer than 1.0".

In some alternative embodiments, the content of carbon fiber or other suitable fiber is from 10% to 60%—which facilitates optimal processing and is sufficient to provide the desired strength and stiffness for the stringed instrument. In other embodiments, the carbon fiber or other suitable fiber content is 20% to 50%. In some alternative embodiments, the carbon fiber or other suitable fiber content is 30% to 40% which provides a desired balance between optimal processing, structural performance and acoustic performance for the stringed instrument. In alternative embodiments, the content of the carbon fiber or other suitable fiber is less than 10% and in other embodiments is greater than 60%.

In some embodiments, various polymeric resin systems may be used with the carbon fiber or other suitable fiber to facilitate the formation of the components of a stringed musical instrument. Both thermoset and thermoplastic resins may be used. In at least one embodiment, thermoplastic resins are polymers that are combined with carbon and other suitable fibers and processed by heating above a melting point, then the material may be forced into a mold or die, and then cooled below the melting point, such that the material is formed with the shape of the mold or die for the stringed instrument or portions thereof.

In at least one embodiment, thermoset resins undergo a chemical reaction during processing, whereby the resin molecules link together to form long chains that turn the liquid resin system into a solid.

In some embodiments, the tonal characteristics of the stringed musical instrument body are affected by both the type and content of carbon fiber, other suitable fibers, and the polymeric resin system selected. By careful selection of the resin system, and the type and percentage of carbon fiber or other suitable fiber, a range of desirable acoustic tonal characteristics may be obtained for the stringed musical instrument.

In an alternative manufacturing process, material is placed into one half of a heated mold, and the other half of the mold is forced down onto the material causing material to flow, and to take the shape of the mold for the body or other portion of the stringed musical instrument. Once the material has flowed, the material is then either cooled below the melting point in the case of a thermoplastic material, or is allowed to chemically react in the case of a thermoset material.

In at least one alternative embodiment, the traditional methods of manufacture with typical layers of fiber composites have been replaced with the disclosed materials and associated manufacturing methods, which offer significant cost and cycle time savings. In some embodiments a reduction in the cost of a particular musical instrument body in excess of 75%, and a reduction in processing time from 8 hours to 3 minutes may also occur. In addition to the cost and time savings, the methods of manufacture for the disclosed invention generally produce much more consistent parts, because there is much less human labor, and chance for variability between manufactured parts of a stringed musical instrument.

In at least one embodiment, in addition to the cost savings, time savings, and consistency improvement, it is much easier to make parts with features, such as ribs, struts, or bosses, which are used for both structural and tonal purposes. With the disclosed invention, the features of ribs, struts, or bosses are easily constructed into the mold, and are molded integrally with the instrument body in a single or multiple step operation.

In one embodiment, invention makes use of carbon or other suitable fibers and glass fiber injection molding materials, along with laminated materials to significantly reduce costs of manufacturing, while retaining a high level of functional and acoustic performance for the stringed musical instrument. The invention also makes use of innovative design concepts to promote performance and cost effective manufacturing.

In one embodiment, a stringed musical instrument comprising a sound box defining an inner space is provided. The sound box comprises a bottom board, a soundboard and a side wall, the bottom board, soundboard and side wall each having an inner surface which faces the inner space, the side wall being between the bottom board and the soundboard, wherein the bottom board and the soundboard each have a periphery, and the side wall has an upper periphery and a lower periphery, the periphery of the soundboard being connected to the upper periphery and the periphery of the bottom board being connected to the lower periphery. In at least one embodiment, the soundboard comprises a sound hole.

A soundboard for a musical instrument is disclosed the soundboard having at least one layer of material. In some embodiments the material comprising carbon fiber, fibrous laminate material, resin or a plastic matrix and combinations thereof. At least one bracing structure is engaged or integral to the at least one layer of material.

In some embodiments, the soundboard and the bottom board may be effectively interconnected via vertical struts attached to the inside of the side wall. The struts may be interconnected without any glue joints between the different struts. The interconnections preserve the desired strength without increasing the rigidity for the sound box. Further, in sound boxes where there are unnecessary constructive reinforcements, sounds tend to interfere. The present system provides a purer sound in which as many parts as possible vibrate at the same frequency.

The invention is also designed so that individual components can be machined separately, reducing costs and increasing consistency of the stringed musical instruments.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying description, in which there are illustrated and described various embodiments of the invention.

DETAILED DESCRIPTION OF THE INVENTION

While this invention may be embodied in many different forms, there are shown in the drawings and described in detail herein specific embodiments of the invention. The present disclosure is an exemplification of the principles of the invention and is not intended to limit the invention to the particular embodiments illustrated. For the purposes of this disclosure, unless otherwise indicated, identical reference numerals used in different figures refer to the same component.

In some embodiments, the soundboard, sound box, and other portions of the stringed instrument may be formed and/or include the features as identified in U.S. patent application Ser. No. 14/055,534 and U.S. Pat. No. 8,450,587 which are incorporated by reference herein in their entireties.

In at least one embodiment, the invention relates to a stringed musical instrument having a sound box 12. For purposes of description, an acoustic guitar is used for illustrative purposes.

Generally referring to the invention, in at least one alternative embodiment, a stringed musical instrument is disclosed having: an injection molded sound box 12 with a neck mounting area 64 comprised of 20% to 50% carbon fiber; a molded carbon fiber soundboard 22 comprised of at least 60% carbon fiber; a single piece carbon fiber reinforced bracing structure 24 that includes raised, hollow stiffeners or braces 26 to minimize top deflection due to string tension and to manipulate acoustic response; a multi-piece neck 60 that makes use of both injection molded components and laminated carbon fiber reinforcements; an attachment mechanism 28 (FIGS. 2 and 3) to attach the neck 60 to the sound box 12 that allows adjustment of the neck 60 with respect to the sound box 12 in two planes, to insure proper relationship of the strings to the neck 60 and sound box 12; and an injection molded carbon fiber bridge 62 that contains internal closed pockets 80 to minimize mass and to reduce bond-line stresses while improving vibrational and sound transfer as well as acoustic response.

In at least one embodiment, an injection molded carbon fiber sound box 12 includes a bracing structure 24 which is used to stiffen the sound box 12 both for structural and sound response. In at least one embodiment, a reinforced area is provided for mounting the neck 60 to the sound box 12.

In at least one embodiment of the invention, a soundboard 22 is comprised of: a uniform thickness composite material and a single piece composite bracing structure 24 that is bonded to the interior side of the soundboard 22. The soundboard may be made as an individual component or cut from a sheet of constant thickness material.

In some embodiments, the bracing structure 24 provides the advantages and/or features of: improved stiffness at a lower weight, thereby reducing the mass of the soundboard 22 for a given stiffness; increasing instrument volume by making the soundboard 22 more responsive; providing a reduction in the mass of the soundboard 22 which lowers resistance to vibration, thereby enhancing the amplitude of top vibration for a given string excitation; and improving the amplitude of soundboard movement which enhances the magnitude of sound waves, thereby increasing instrument volume. The bracing structure 24 in conjunction with the soundboard 22 also improves sustain by reducing the energy requirement for soundboard vibration for a given amplitude. In at least one embodiment, less energy is lost on each vibration cycle, because less mass must be vibrated. The bracing structure 24 in conjunction with the soundboard 22 reduces manufacturing time by eliminating operations to cut and bond multiple braces together as well as increasing the overall integrity of the soundboard 22 by significantly improving the bond area for the bracing structure 24. The bracing structure 24 in conjunction with the soundboard 22 reduces potential for brace bond failure. The bracing structure 24 disclosed herein is not prone to crack or split and functions to minimize stress concentrations at brace interface locations, thereby creating a more uniform stress distribution in the soundboard 22.

In some alternative embodiments, a soundboard 22 is comprised of a constant thickness face sheet and a single piece molded brace 24 that is bonded to the interior of the soundboard 22. In some embodiments, the constant thickness face sheet is comprised of a molded carbon fiber reinforced material. In some other embodiments, the single piece brace 24 is injection or compression molded from a material comprised of short carbon fibers and a polymeric matrix. In some alternative embodiments, the single piece molded brace 24 is comprised of a chopped carbon fiber and thermosetting resin, such as epoxy, vinyl ester, or polyester. In some embodiments, the single piece molded brace 24 is comprised of chopped carbon fiber and a thermoplastic resin, such as ABS, Nylon, or Rigid Thermoplastic Urethane.

In at least one embodiment, a stringed musical instrument is formed of carbon and glass fiber injection molded materials, along with a small amount of laminated materials, which significantly reduces the costs of manufacture while retaining a high level of functional and acoustic performance. In at least one embodiment, the use of carbon fiber reinforced injection molded polymers may provide superior acoustic response for the stringed musical instrument.

In other embodiments, adhesive (e.g., thermosetting polymers, such as epoxy, polyester, polyurethane, and combinations thereof) is used to bond the soundboard 22 to the single piece molded bracing structure 24. In some embodiments, the adhesive is in the family of cyanoacrylate instant bonding adhesives or other suitable adhesives, or bonding agents. In some embodiments a heat activated thermoplastic adhesive may be used to attach the bracing structure 24 to the interior of the soundboard 22. In alternative embodiments, both the guitar sound box 12 and the guitar neck 60 are made primarily of composite materials, including those reinforced with carbon, glass, or aramid fibers.

In at least one embodiment, an adjustable guitar neck 60 is provided as an attachment method which permits manipulation of the neck 60 vertically up and down, and horizontally left to right, for easy adjustment of neck and/or string alignment. The attachment method in at least one embodiment involves a 3-point interface, with a pivot point and two independently movable adjustment points, which allows the neck 60 to be adjusted by simple adjustment of two screws 66. This alternative method also eliminates the need to adjust the height of the strings at the bridge 62.

In some embodiments, the mounting and attachment bolts 68 may be inserted from the neck side to the sound box side. In some other embodiments, the mounting and attachment bolts 68 are inserted from the inside the sound box and into the neck 60. In some other alternative embodiments, metal threaded inserts are used to spread out force and to prevent local damage from the mounting bolts 68 and adjustment screws 66 as used in the neck attachment area 64.

In at least one embodiment, the fingerboard/fret board 44 provides for a minimum weight neck 60. In some embodiments, the neck 60 is molded to be substantially hollow 42.

In some embodiments, high stiffness laminates are positioned near the top and bottom of the neck assembly. Reinforcement fibers are positioned farther from the neck's neutral axis as opposed to the reinforcement fibers becoming an integral part of the neck-reducing the need for reinforcement for a given stiffness. In at least one embodiment, low structural efficiency material in the fingerboard/fret board 44 and neck 60 is replaced with high structural efficiency laminates—adding significant stiffness with very little additional mass. In some embodiments, it is the goal to improve manufacturing effectiveness by utilizing high efficiency and low difficulty operations. Injection molding provides cost effective and fast fabrication which may be utilized to provide the complex shape of the neck 60. In at least one embodiment, the parts utilized in the neck 60 are designed to be self aligning and to fit closely together to improve assembly efficiency.

In some embodiments, the musical instrument neck 60 comprises: a fiber reinforced compression or injection molded hollow/pocket neck section 42, with an integral headstock section 48; a heel section 50; a fiber reinforced injection molded fingerboard 44 comprising a carbon fiber insert 58 having a molded pocket 52 for receipt of a carbon fiber insert 56; the carbon fiber inserts 56, 58 adding stiffness and stability to the neck assembly; one or more heel inserts 54 either in the form of a solid metal bar or threaded metal inserts for receiving the mounting bolts 68; a headstock veneer 74 that may act as a structural member and/or a decorative cover; an injection molded fiber reinforced headstock insert 76 that supports the headstock back, such that tuning keys can be installed into the headstock 48, which additionally provide self-locating features to fit the neck 60 and headstock veneer 74 together in a desired orientation; where in the fingerboard 44 that has been designed and reinforced to act both as a playing surface and a structural member. A neck insert 46 may be provided for placement into the neck pocket 42 to enhance the structure of the neck 60. In some embodiments, heel inserts 54 are not used. In some embodiments, the fingerboard 44 comprises an outer material to provide a suitable playing surface and to accept frets (if used) and an inner material to provide structural stiffness comprised of a stiff, fiber reinforced resin or plastic.

In some embodiments, a pocketed guitar bridge 62 may be used to improve the acoustical response of the stringed instrument by reducing the mass of the bridge 62. The pocketed guitar bridge 62 increases volume by making the soundboard 22 more responsive by increasing the amplitude of vibration of the soundboard 22 for a given string excitation. In some embodiments, reducing bridge mass reduces the resistance of the soundboard 22 to vibration, improving vibration energy and creating more soundboard 22 movement and volume for the stringed instrument. The pocketed guitar bridge 62 may also increase sustain by reducing the energy requirement for vibration of the soundboard 22 for a given amplitude. Less vibration energy may also be lost on each vibration cycle, because a lower mass is required to be vibrated on each vibration cycle. The pocketed guitar bridge 62 may also reduce bridge stiffness increasing soundboard flexure and provide larger amplitude vibrations, thereby increasing the volume of response. The pocketed guitar bridge 62 may also reduce peak bondline stresses on the soundboard 22 reducing potential for bondline failure. The bondlines such as the contact surface between the bridge 62 and the soundboard 22, may be stressed proximate to the edges of the bridge 62. The use of a pocketed bridge 62 reduces maximum shear stress by increasing the number of bondline edges for engagement to the soundboard 22.

In at least one embodiment, a fiber reinforced injection or compression molded guitar bridge 62 is provided where material has been removed from the underside of the bridge 62 to create pockets 80 proximate to the soundboard 22, wherein the pockets 80 are created in areas of low stress within the bridge 62. In some embodiments, the bridge 62 is made primarily of carbon fiber and a thermoplastic materials, such as polyphenylene sulfide, polethersulfone, polyetheretherketone, thermoplastic polyurethane, or a thermosetting resin, such as epoxy or polyester. In some embodiments, the method of manufacture is injection molding; however, other manufacturing methods may be utilized. In some embodiments, the pockets 80 are molded into the bridge 62. In other embodiments, the pockets 80 are machined into the bridge 62 after molding.

In at least one embodiment, the soundboard 22 comprises a sound hole 32 and a bracing structure 24 comprising a plurality of braces 26 or bracing elements facing the inner space, each of the braces 26 having a length, a thickness and, a width.

As shown in FIG. 1, in at least one embodiment, guitars have a hollow guitar body or sound box 12. Sound box 12 has a waist generally indicated at 14 which identifies the narrowest portion or mid-section of the guitar. The portion of the guitar body above the waist 14 is known as the upper bout and is generally designated at 16. The portion of the guitar body below the waist 14 is generally known as the lower bout and is generally designated in the figure at 18.

In some embodiments, the top, as seen in FIG. 1 of guitar hollow body or sound box 12 is known as the soundboard 22. The soundboard 22 has a sound hole 32 and at its periphery, defines the edges of the upper bout 16, the lower bout 18, and the edges of the waist portions of the sound box 12. The edges of the soundboard 22 are connected to a side panel or side wall 34, and in turn are connected to the rear panel or bottom board 36, to form the hollow body, as is typical of guitars. In at least one embodiment as seen in FIG. 1, the side wall 34 is typically one piece and is shaped to form the side of the sound box 12.

As is conventional in guitars, a neck 60 is attached to the sound box 12 to extend from the soundboard 22. A bridge 62 is also anchored to the exterior side of the soundboard 22 to transfer vibrations into the sound box 12. Strings extend along neck 60 and are received by the bridge 62, thereby supporting strings over the soundboard 22. Strings are attached at the distal end of the neck 60 in any conventional manner known in the art, preferably in such a way to allow for tension adjustment of the strings.

In at least one embodiment, the invention involves making a soundboard 22 for a composite stringed musical instrument where the soundboard 22 is formed of a uniform thickness composite material including carbon fiber. The soundboard 22 may be formed as an individual component, or may be cut from a sheet of constant thickness material. In some embodiments the soundboard 22 is formed by a molding manufacturing process and is comprised of at least 60% carbon fiber. In some embodiments the soundboard 22 is formed of other suitable fibers as well as carbon fibers.

In at least one embodiment, the soundboard 22, as molded or formed of carbon fibers, and other suitable fibers and materials, improves the stiffness of the soundboard 22 at a lower weight—thereby reducing the mass of the soundboard 22 for a given stiffness. The provision of a soundboard 22 formed of carbon fibers, and other suitable fibers and materials, increases the volume of the stringed musical instrument; improves the responsiveness of the soundboard 22; lowers resistance to vibration; increases the amplitude of vibration; and enhances the magnitude of sound waves improving instrument volume. In addition, the provision of a soundboard 22 formed of carbon fibers, and other suitable fibers and materials, improves the sustain for the stringed musical instrument by reducing the energy requirement for vibration of the soundboard 22 for a given amplitude. Therefore, less energy is lost on each vibration cycle, because less mass must be moved/vibrated.

In some embodiments, the soundboard 22, sound box 12, and other portions of the stringed instrument may be formed of carbon fiber, resin, or plastic matrix or combinations thereof. In some embodiments, the soundboard 22, sound box 12, and other portions of the stringed instrument may be formed of Nomex fiber in a resin mix; glass fiber in a resin mix; paper in a resin mix; carbon fiber in a resin mix; polymers such as polypropylene; polyvinyl chloride; ABS; polycarbonate; carbon faced foam; carbon graphite; carbon graphite fabric; fiber cloth matrix; fiber cloth and resin matrix; plastics; composite materials; fiberglass; glass foam; beryllium; a fiber glass epoxy blend, other fibrous materials incorporating glass, silicon carbide, and/or other suitable materials and combinations of the materials as identified herein. It should be noted that the materials identified herein are representative, and are not intended to be limiting of the types of materials which may be utilized for either the soundboard 22, sound box 12 or other portions of the stringed musical instrument as described herein.

While carbon fiber is viewed as the fiber of choice for at least one embodiment used in the soundboard 22, it is anticipated that other fibers may provide acceptable performance. Alternate fibers may include but are not limited to fiberglass, silicon carbide, Nextel (3M trademark) or other ceramic fiber or other fibers.

In other embodiments, the soundboard 22 may be formed of two, or multiple individual layers of molded material, where each layer is formed of the identical composition of elements or manufacturing techniques. In other embodiments, the individual layers of material may be formed of different materials or manufacturing techniques. In further embodiments, the individual layers of material may alternate in any regular or irregular sequence for combination together to provide a desired level of vibration, tonal characteristics, acoustic response or performance for a soundboard 22 of a stringed musical instrument.

In at least one embodiment, an additional layer of material 84 may be engaged to the soundboard 22 at certain designated locations in order to increase the stiffness of a region of the soundboard 22, such as for example proximate to a bridge 62, which is attached to the top of the soundboard 22. In certain embodiments, additional sections or layers of carbon fiber or fibrous laminate material may be added to localized regions of a soundboard 22, which are specifically designed to reduce the adverse structural effects of string tension. In some embodiments the additional layer of material 84 may comprise a material of higher stiffness than the soundboard 22. Suitable materials for the additional layer may include, but are not limited to the materials as identified herein. In some embodiments an additional layer of material may be engaged to the sound box 12 proximate to the neck block area 64 and/or the sound hole 32 in order to provide greater support in those areas.

Although the thicknesses of the soundboard 22 may vary, suitably the soundboard 22 may have an initial thickness of between approximately 0.0625 inch and 0.5000 inch.

In at least one embodiment, the bracing structure 24 is bonded to the inside of the soundboard 22. In some embodiments, the bracing structure 24 is a unitary molded structure providing the following: improved stiffness at a lower weight, thereby reducing the mass of the soundboard 22 for a given stiffness; increased instrument volume and improved soundboard 22 responsiveness; lowered resistance of the soundboard 22 to vibration, thereby increasing the amplitude of vibration for a given string excitation; and improved sustain by reducing the energy required to vibrate the soundboard 22 for a given amplitude, in that less energy is lost on each vibration cycle because less mass must be vibrated.

In at least one embodiment, the overall integrity of the soundboard 22 is improved by significantly increasing the bond area for engagement of the bracing structure 24 to the soundboard 22, which in turn reduces the potential for brace bond failure. In at least one embodiment, the unitary molded bracing structure 24 is not prone to cracking or splitting and minimizes stress concentrations at brace interface locations with the soundboard 22, thereby creating a more uniform stress distribution with the soundboard 22.

In at least one embodiment, the unitary bracing structure 24 having braces 26 may be affixed/attached, secured, and/or bonded to the interior side of a soundboard 22, for vibration in unison with the soundboard 22, to provide the desired tonal characteristics for the stringed musical instrument.

In at least one embodiment, the unitary molded bracing structure 24 is molded from a resin system and a chopped or milled fiber, preferably carbon fiber, but other fibers, such as glass, basalt, silicon carbide, or ceramic fibers may be used. In some embodiment, the resin system may be either thermoplastic, such as ABS, acrylic, polycarbonate, nylon, or thermoset, such as epoxy, phenolic, viny lester, polyester, or combinations thereof. In some embodiments, the molding process for the unitary bracing structure 24 may be either injection molding, compression molding, or transfer molding, or similar process for molding the identified materials together to form the desired bracing structure shape. In some embodiments, strips of continuous fiber reinforcement may be bonded to the unitary bracing structure 24, to form an integrated bracing structure after molding, to increase stiffness and acoustic performance for the stringed musical instrument.

In at least one embodiment, the unitary molded bracing structure 24 may be carbon fiber reinforced, which may include raised, hollow stiffeners or braces 26 to minimize top deflection due to string tension and to manipulate acoustic response.

It should be noted that the materials identified herein are representative, and are not intended to be limiting of the types of materials which may be utilized for either the soundboard 22 or the unitary bracing structure 24 as described herein.

In at least one embodiment, the braces 26 may be arranged into a traditional, non-traditional, or random bracing pattern including straight sections or curved sections which are disposed within the interior peripheral edge of the soundboard 22. In some embodiments, the straight sections or curved sections may cross one another at perpendicular or non-perpendicular angles to enhance the structural integrity of various locations of the soundboard 22.

In some embodiments, the unitary bracing structure 24 may be molded to provide an adjustable or variable stiffness to selected portions of the soundboard 22. The stiffness for a soundboard 22 may be varied or adjusted by the initial selection or designation of the materials to be utilized for the unitary bracing structure 24. In other embodiments, the unitary bracing structure 24 may have consistent or inconsistent thickness dimensions at certain locations, to adjust the stiffness and vibration of the soundboard 22 to achieve a desired tone or acoustic response.

In some embodiments, the dimensions and/or the shape of the braces 26 may vary between braces 26 or at certain locations within a section or grouping of braces 26. In some embodiments, all of the braces 26 have an identical shape and size. In other embodiments, the braces 26 are not identical, and certain braces 26 may have any particular shape or size for positioning at certain locations relative to a soundboard 22, to provide a desired vibration, tone or acoustic quality or response, to maintain the structural integrity for the stringed instrument.

In some embodiments, the width, height, depth, thickness, and/or shape of the braces 26 and/or the unitary bracing structure 24 may gradually or dramatically change by increasing or decreasing dimensions, along the length of the unitary bracing structure 24 or at certain desired locations, in order to provide the desired sound quality or tone effect for the soundboard 22. The superior performance may be based on two characteristics (a) the high structural efficiency—that is stiffness for a given weight, and (b) the ability to effectively shape the tonal response.

In some embodiments, a soundboard 22 including the unitary bracing structure 24 may have a bending stiffness ratio of approximately 1 to 1. In other embodiments, the bending stiffness ratio may be greater or less than 1 to 1 as desired for a particular stringed instrument. In certain embodiments, the unitary bracing structure 24 is used to facilitate the structural integrity of a soundboard 22 exposed to string tension and to simultaneously shape the tonal acoustic and vibrational properties to provide a desired natural warm sound for the stringed instrument.

In at least one embodiment the soundboard 22 has been formed separately from the unitary bracing structure.

The above relationships are very complex, and a low mass, high stiffness soundboard 22 will not necessarily create a desirable acoustic response—however, the high stiffness for a given weight makes the carbon fiber unitary bracing structure 24 a superior brace material.

The other benefit of the material selected for the unitary bracing structure 24 is that it effectively damps the excess upper mid and upper frequencies that carbon fiber soundboards 22 tend to produce—these frequencies can provide a harsh tone, especially at higher volume levels.

In some embodiments, the thickness dimension for any location on the unitary bracing structure 24 may be identical, may differ, or vary relative to other areas at any location relative to the soundboard 22. Additional layers or thickness of material may be added to the unitary bracing structure 24 in areas of high stress to add stiffness and strength.

In at least one embodiment any combination of bracing structures 24 as identified herein may be affixed, engaged, bonded, integral with or otherwise attached to a soundboard 22.

In at least one embodiment, the bracing structure 24 becomes more a part of the soundboard 22 than extension of it. In at least one embodiment, the bottom board 36 includes braces 26 as described relative to the bracing structure 24. In some embodiments, the sound box 12 may include struts, where the struts may be used in the side wall 34 and may also have the properties and features of the braces 26 as described herein.

In at least one embodiment of the soundboard 22 and/or the bottom board 36, the braces 26 are neither parallel nor perpendicular to one another. The individual braces 26 are generally continuous from their individual origination points to their ending points.

In some embodiments, changing the profiles of the braces 26 creates more stiffness where loads are greater. It should be understood that the braces 26 may have different configurations as needed for positioning on the soundboard 22.

In some embodiments, the braces 26 may also slope at their termination points. Among other reasons, this is to accommodate the side wall 34, which is adhered to the periphery of the soundboard 22. This configuration may provide strength and rigidity without sacrificing the vibration capabilities throughout the sound box 12.

In some embodiments a traditional bracing structure having a plurality of spaced apart braces 26 may be organized into a pattern. In at least one alternative embodiment the bracing structure will be a master die structure and a matching press structure of a die set which may be utilized to facilitate formation of the unitary bracing structure 24.

Those skilled in the art will be readily aware of other types of molding/formation procedures, as well as alternative types of materials may be utilized in the manufacture of the unitary bracing structure 24 having braces 26. In at least one embodiment, the braces 26 are formed of carbon fibers, other suitable fibers, fiberglass, composite or other materials.

In at least one embodiment as may be seen in FIGS. 1 and 6A, 6B, 6C and 6D, the unitary bracing structure 24 may conform to the shape of a soundboard 22 and include a sound hole 32, and the braces 26. In at least one embodiment, the unitary bracing structure 24 may also include an upper bout area 16, a waist area 14, and a lower bout area 18.

In at least one embodiment, the bracing structure 24 having the attributes identified herein may also be used on the interior of the bottom board 36. In at least one embodiment, the sound holes 32 of the soundboard 22 and the bracing structure 24 are aligned. In some embodiments, the bracing structure 24 may be trimmed along the exterior edges to conform to the desired shape for the soundboard 22. In at least one embodiment, the materials and shape of the bracing structure 24 provide sufficient structure to the soundboard 22 to prevent cracking, bending, warping, or other load related problems following the tightening of strings from the bridge 62 to the neck 60 of the musical stringed instrument.

In some embodiments the braces 26 define elongate cavities or resonance channels or spaces which may be rectangular, semi-circular, or any other geometric shape which is selected to provide unique resonance properties for the sound box 12 of the musical instrument. In some embodiments the bracing structure 24 corresponds to the size, shape, and/or configuration of traditional braces used with a soundboard 22.

In some embodiments, the acoustical and resonance characteristics of the soundboard 22 may be adjusted by modification of the width, height, thickness, depth, and/or shape of the bracing structure 24 and/or the braces 26. In some embodiments, the width, height, depth, thickness, and/or shape of the braces 26 may gradually or dramatically change by increasing or decreasing dimensions, along the length of the braces 26, or at certain desired locations, in order to provide the desired sound quality or tone effect.

In some embodiments the use of a bracing structure 24 as bracing for a soundboard 22 facilitates uniformity in the crafting of a soundboard 22 for a musical instrument reducing waste and improving sound quality. In some embodiments the use of a bracing structure 24 as bracing for a soundboard 22 limits the number of variables associated with the formation of a soundboard 22 for a musical instrument. Variables would include but are not necessarily limited to vibrational differences inherent in different pieces of wood used to form the traditional braces and/or soundboard 22.

In at least one embodiment all of the braces 26 may be formed of a common shape having substantially identical internal cavities or resonance spaces. In at least one embodiment, one or more braces 26 may include a combination of different shapes and different internal cavities or resonance spaces along the length, or at different locations along the length, of the braces 26.

In at least one embodiment, a bracing pattern formed of braces 26 may be provided, where the braces 26 are individually formed of different shapes, or sections of the pattern of braces 26 are formed of either the same or different shapes. In at least one embodiment an individual brace 26 may be formed of one, two, or more different shapes, to yield a desired tone for the soundboard 22.

Figure 6A:
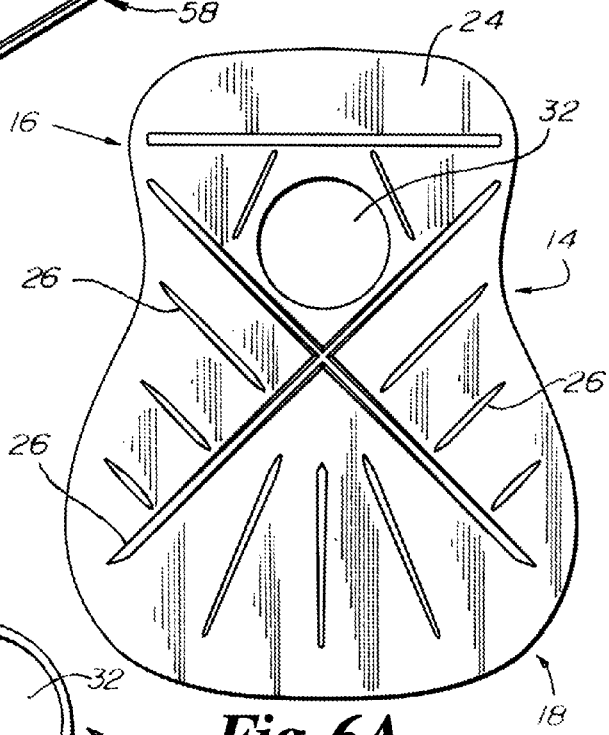
FIG. 6A is a detail bottom view of one alternative embodiment of a bracing structure of a stringed musical instrument.

In at least one embodiment as shown in FIG. 6A a bracing structure 24 includes a circular sound hole 32 position centrally in the upper bout 16 section of a soundboard 22. A pair of elongate braces 26 cross the bracing structure 24 and a plurality of shorter braces 26 are positioned in a symmetrical and regular location within the bracing structure 24. The overall bracing pattern is regular and symmetrical about a central axis which vertically bisects the bracing structure 24.

Figure 6B:
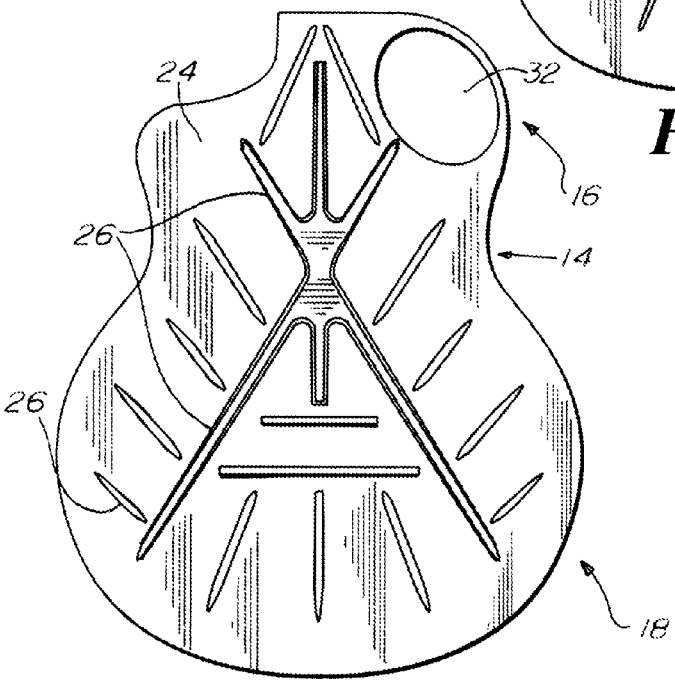
FIG. 6B is a detail bottom view of one alternative embodiment of a bracing structure of a stringed musical instrument.

In at least one embodiment as shown in FIG. 6B the overall shape of the bracing structure 24 is not symmetrical in shape. In the embodiment as depicted in FIG. 6B the bracing structure 24 in the lower bout 18 section is symmetrical in shape, and the bracing structure 24 in the upper bout 16 is not symmetrical in shape. In the embodiment depicted in FIG. 6B the sound hole 32 is offset and is shaped in the form of an oval which is located proximate to the peripheral edge of the bracing structure 24 in the upper right quadrant. In the embodiment shown in FIG. 6B a pair of braces 26 cross each other and a central junction section is provided. A plurality of shorter braces 26 are positioned in a symmetrical or regular location within the bracing structure 24. The overall bracing pattern is regular and symmetrical about a central axis which vertically bisects the bracing structure 24.

Figure 6C:
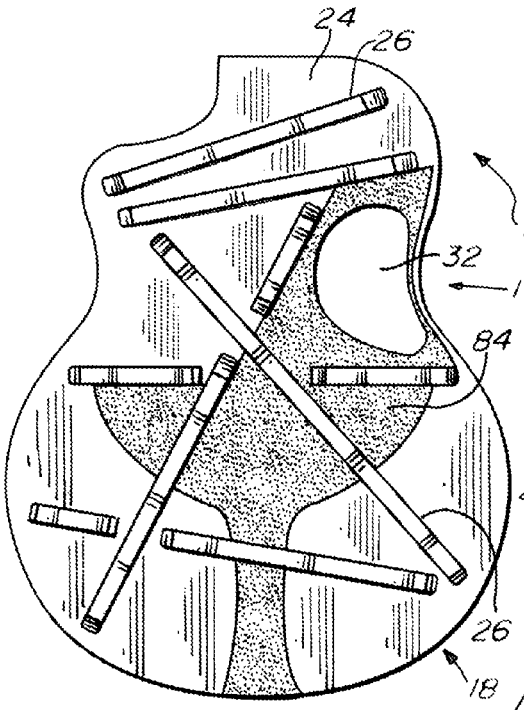
FIG. 6C is a detail bottom view of one alternative embodiment of a bracing structure of a stringed musical instrument.

In at least one embodiment as shown in FIG. 6C the overall shape of the bracing structure 24 is not symmetrical in shape. In the embodiment depicted in FIG. 6C the bracing structure 24 in the lower bout 18 section is symmetrical in shape, and the bracing structure 24 in the upper bout 16 section is not symmetrical shape. In the alternative embodiment depicted in FIG. 6C, the sound hole 32 is offset and is substantially kidney shaped which is located proximate to the peripheral edge of the bracing structure 24 proximate to the waist 14, on the right side. In the alternative embodiment shown in FIG. 6C the braces 26 are positioned at angles relative to each other and a plurality of longer and shorter braces 26 are used. In the alternative embodiment shown in FIG. 6C the braces 26 are disposed in an irregular pattern of large, mid-length, and shorter braces 26. In the embodiment shown in FIG. 6C the braces 26 are disposed in a desired location to provide a particular acoustic response and desired tonal quality for a stringed musical instrument.

Figure 6D:
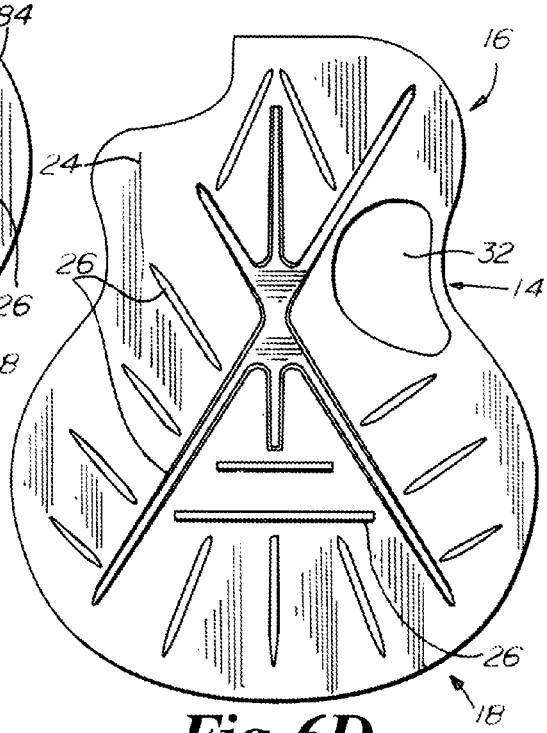
FIG. 6D is a detail bottom view of one alternative embodiment of a bracing structure of a stringed musical instrument.

In the alternative embodiment as depicted in FIG. 6D the bracing structure 24 is substantially identical to the bracing structure 24 as depicted in the alternative embodiment as shown in FIG. 6B, with the exception that the sound hole 32 is substantially kidney shaped and has been relocated from the upper right quadrant to a position proximate to the peripheral edge of the waist 14 on the right side.

In some embodiments as depicted in FIG. 6C an additional layer or one or more plies of material 84 have been added to either the soundboard 22 or to the bracing structure 24 at a desired location to enhance the stiffness and structural integrity of the soundboard 22 to provide a particular acoustic response and/or desired tone quality for the stringed musical instrument, while simultaneously enhancing the structural integrity and prolonging the useful life of the soundboard 22 and bracing structure 24.

In at least one embodiment, the performance of the soundboard 22 and/or the bracing structure 24 may be easily modified by the addition or removal of one or more plies 84 of material from the molded bracing structure 24. In some embodiments, in size or shape of plies 84 of additional material may be added to the bracing structure 24 as shown in FIG. 6C in order to increase stiffness of the soundboard 22 in selective locations. In some embodiments, the one or more plies 84 of material may be of increased or decreased stiffness as compared to the bracing structure 24, however, the overall stiffness of the bracing structure 24 is increased following the addition of at least one ply 84 of material. In some embodiments, the one or more plies 84 of material may be formed of fibers which may provide enhanced stiffness to the soundboard 22 without significantly altering the overall mass of the soundboard 22.

In at least one embodiment, when the sound box 12 is assembled, the termination points of the braces 26 of the soundboard 22 are generally located above the corresponding termination points of the braces 26 for the bottom board 36. The corresponding points may be linked by the struts 82 to create the composite bracing system. It should be noted that in at least one embodiment that braces 26 are not used on the bottom board 26.

In at least one embodiment, a particular, but not the exclusive, feature of the composite bracing system is the ability of the interconnection of the braces 26 via the struts to disperse stress and strain throughout the system. The positioning and the configuration of the braces 26 and struts provide strength and stiffness for the sound box 12 without adding unnecessary weight, while providing for uniformity of vibration and pureness of sound.

In at least one embodiment, any combination and/or pattern of identical or different braces 26 may be utilized within a bracing structure 24, for attachment to either the interior side of the soundboard 22 and/or the interior side of the rear panel/bottom board 36 to form the sound box 12 for a musical instrument.

In some embodiments, the sound box 12, neck 60, and the side wall 34 are formed of carbon fiber and other suitable fibers which are used in an injection molding process to form the sound box 12, neck 60 and side wall 34. In some embodiments, side wall 34 and/or reinforcing ribs or struts as well as the neck 60 are comprised of 20% to 50% carbon fiber.

In some embodiments, the injection molded reinforcing ribs or struts function to stiffen the side wall 34 for either structural considerations or sound response or both structural considerations and sound response. In at least one embodiment, the side wall 34 in the area of the upper bout 16 includes a reinforced neck mounting area 64. In alternative embodiments, the injection molded side wall 34, reinforcing ribs or struts as well as the neck mounting area 64 are formed at a significant cost savings as compared to compression molded or laminated instrument bodies. In addition, the use of carbon fiber reinforced injection molded polymers provide superior acoustic response for the side wall 34 and the sound box 12.

In some embodiments, the ribs or vertical struts may be aligned with the termination points of the braces 26. It should be understood that the number of struts may vary for a particular type of stringed musical instrument in order to provide a desired sound quality. In at least one embodiment, the struts are generally perpendicular with the soundboard 22.

In some embodiments, the bottom board 36 may be formed of carbon fiber or other suitable fibers or materials as earlier described with respect to the soundboard 22. In at least one embodiment, when the soundboard 22 is placed over the side wall 34 above the bottom board 36, with the upper bouts 16 and the lower bouts 18 aligned, the termination points of the braces 26 of the bottom board 36, if used, are aligned in an opposing fashion with the termination points of the braces 26 of the soundboard 22. In at least one embodiment, each of the braces 26 of the bottom board 36, if used, mirror the braces 26 of the soundboard 22.

In at least one embodiment, the stringed musical instrument includes a neck 60 which is engaged to the neck mounting area 64 of the sound box 12. In general, the neck 60 includes the elements of the heel 50 which may include a heel insert 54; a hollow or pocket 42; a neck insert 46 for placement in the pocket 42; a headstock 48; a headstock insert 76 for placement into the headstock 48; a headstock veneer 74 for engagement to the headstock insert 76; a fret board 44 formed of a carbon fiber insert 58 having a molded pocket 52 and another carbon fiber insert 56 for placement into the molded pocket 52; and an attachment mechanism 28 including adjustment screws 66 and mounting bolts 68.

In some embodiments, a heel insert 54 is disposed into the heel 50. In other embodiments, a heel insert 54 is not used.

In at least one embodiment, the neck 60, and components of the neck 60, with the exception of the adjustable screws 66 and mounting bolts 68, are formed of carbon fiber material and/or other suitable fiber material as earlier identified herein. In some embodiments, the elements of the neck 60 are formed through the use of an injection molding process or other suitable manufacturing process to reduce manufacturing and assembly expense. In some embodiments, the elements of the neck 60 may be formed through both an injection molding process and through the use of a lamination process for manufacture of carbon fiber reinforced elements.

In at least one embodiment, the attachment mechanism 28 for engagement of the neck 60 to the sound box 12 may provide adjustable positioning of the neck 60 relative to the sound box 12. In alternative embodiments, the attachment mechanism 28 does not provide for adjustable positioning of the neck 60 relative to the sound box 12.

In at least one embodiment, the attachment mechanism 28 allows adjustable attachment of the neck 60 with respect to the sound box 12 in two planes in order to facilitate the proper positioning of the strings relative to the neck 60 and the sound box 12. In some embodiments, the attachment mechanism 28 allows for adjustment of the neck 60 vertically up and down and/or horizontally left to right in order to facilitate adjustment and proper string alignment of the strings relative to the neck 60 and the sound box 12.

At least one embodiment, the attachment mechanism 28 is based on a three point interface, with a pivot point and two independently movable adjustment points. In at least one embodiment, the mounting bolts 68 are disposed lower than the adjustment screws 66, and the mounting bolts 68 function as the vertical pivot point while the adjustment screws 66 are independently adjustable for lateral or horizontal alignment of the neck 60 to the left or right relative to the sound box 12.

One of the most time consuming operations in the construction of a stringed musical instrument is alignment and positioning of the neck 60 relative to the sound box 12. A typical set-up procedure utilizes a trial and error process that involves removing material from the neck heel 50, or by adding or adjusting shims into the neck mounting area 64.

In at least one embodiment as disclosed herein the attachment mechanism 28 permits the adjustment of the neck 60 by the manipulation of the adjustment screws 66. In at least one embodiment, the mounting bolts 68 permit adjustment of the neck 60 at a slight angle vertically upward or downward relative to the sound box 12, while the adjustment screws 66 permit adjustment of the neck 60 horizontally left to right, providing a two way adjustment for the neck 60. In at least one embodiment, the attachment mechanism 28 enables the adjustable positioning of the neck 60 relative to the sound box 12 without the removal of the strings from the stringed musical instrument. In some embodiments, the utilization of an attachment mechanism 28 enables adjustment of the position of the neck 60 when the neck angle relative to a sound box 12 has changed over time, which in turn has displaced the desired location of the strings relative to the sound hole 32 or sound box 12.

In at least one embodiment, the attachment mechanism 28 provides a structurally efficient method of attaching a composite neck 60 to a sound box 12. The injection molding of the neck 60 provides for a cost-effective and rapid fabrication process for the complex shape of the neck 60, where portions of the neck 60 are constructed to be self-aligning and to fit closely together to enhance the efficiency of assembly of the stringed musical instrument.

Composite materials are typically proficient at carrying stresses in a plane, and in a bearing relationship, however composite materials may not be as effective at carrying loads through corners, particularly when used with a stringed musical instrument. In at least one embodiment, the mounting bolts 68 provide an effective method for making the 90° connection between a musical instrument neck 60 and the sound box 12 for a composite material stringed musical instrument.

In at least one embodiment, the upper structural reinforcement for the neck 60 is moved into the fingerboard 44. This in turn moves the reinforcement fibers further from the neutral axis as opposed to making the reinforcing fibers and integral part of the neck 60. In certain embodiments this feature enables the use of less reinforcement material for a desired level of stiffness for the neck 60 and/or sound box 12.

In at least one embodiment, the use of molded carbon fibers, or other suitable fibers in the carbon fiber inserts 56, 58 as well as the neck 60, and neck insert 46 enables the replacement of low structural efficiency material in the lower part of the fingerboard 44 and neck 60, with high structural efficiency material, which in turn may provide a significant stiffness improvement to the neck 60 with very little additional mass.

In at least one embodiment, the manufacture of the heel 50 as a separate molded or machined piece avoids the implementation of a complex lamination operation or process, which in the past has been required in order to make a complex heel as a portion of the neck 60. In at least one embodiment the heel 50, heal insert 54, headstock insert 76, and fingerboard 44, as well as other parts of the neck 60 may be formed through the use of a CNC machine, or molded by an injection molding process. In other embodiments the neck 60 is conducive to manufacture through the implementation of a simplified lamination operation. In at least one embodiment, the headstock veneer 74 is machined from laminated flat sheets of composite material or other suitable materials.

Figure 9:
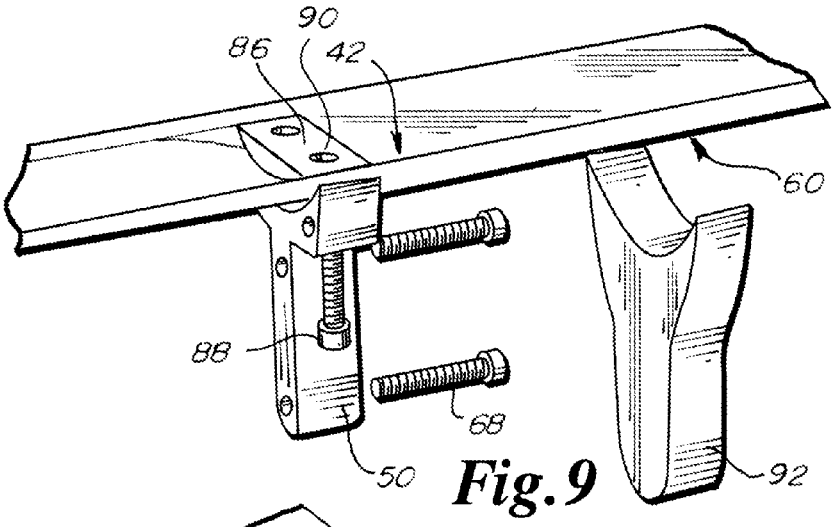
FIG. 9 is a detail perspective view of one alternative embodiment of a neck and heel of a stringed musical instrument.

In at least one embodiment as depicted in FIG. 9, a heal attachment block 86 is disposed in a hollow or pocket 42 of the neck 60, and is vertically aligned with respect to the heel 50. Heal attachment bolts 88 may then pass through aligned apertures 90 in the heal attachment block 86 in order to sandwich the neck 60 between the heal attachment block 86 and the heel 50, to secure the heel 50 to the neck 60. A heal cover 92 may then be disposed over the heel 50 during assembly of the stringed musical instrument.

Figure 2:
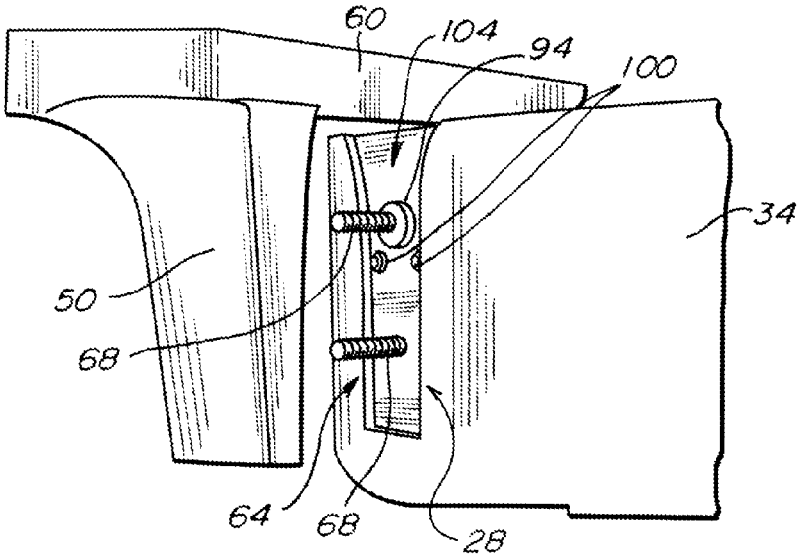
FIG. 2 is a detail perspective view of one alternative embodiment of an instrument neck and sound box of a stringed musical instrument.
Figure 4:
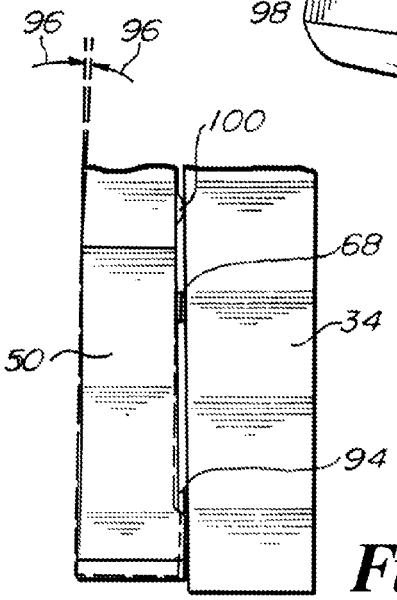
FIG. 4 is a detail side view of a heel and neck mounting area of one alternative embodiment of a stringed musical instrument.
Figure 5:
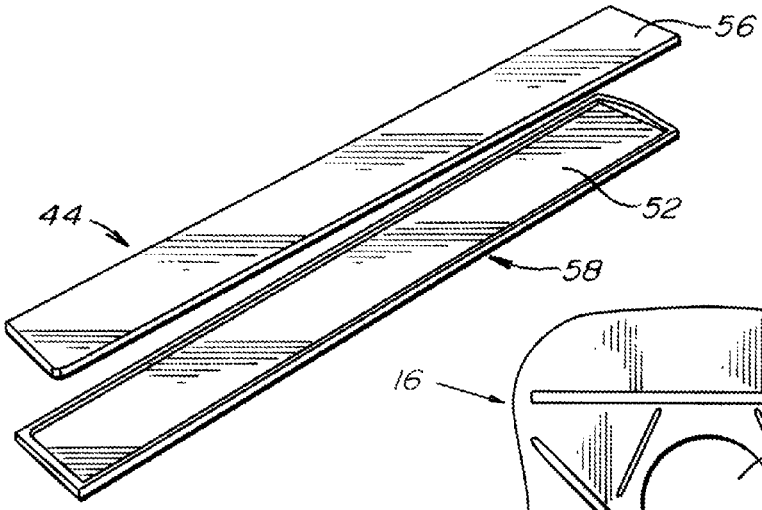
FIG. 5 is an exploded isometric view of one alternative embodiment of a fretboard or fingerboard of a stringed musical instrument.

In at least one embodiment as depicted in FIG. 2, a spherical pivot 94 is disposed over the upper mounting bolt 68. In at least one alternative embodiment, the spherical pivot 94 is disposed over the lower mounting bolt 68. In at least one embodiment the adjustment of the neck mounting bolts 68, and the tightening of the mounting bolts 68 relative to the spherical pivot 94, provides vertical alignment of the neck 60 relative to the sound box 12 as depicted by arrows 96 of FIG. 4.

In at least one embodiment, the heel 50 includes adjustment/affixation apertures 98 which are adapted to receive the adjustment screws 66 and mounting bolts 68. In some embodiments the affixation/adjustment apertures 98 are threaded, and in other embodiments the affixation/adjustment apertures 98 are not threaded, and the mounting bolts 68 engage nuts to secure the heel 50 and neck 60 to the sound box 12.

Figure 3:
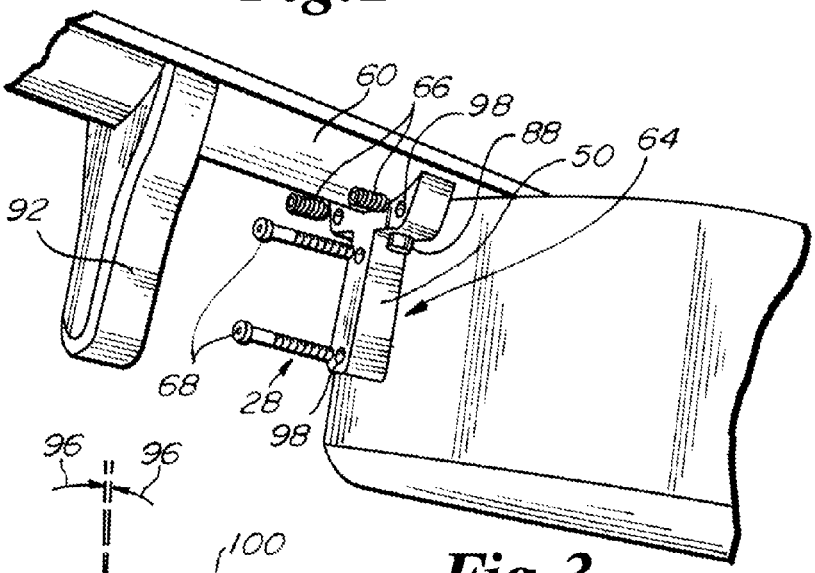
FIG. 3 is a detail perspective view of one alternative embodiment of an instrument neck and sound box of a stringed instrument.
Figure 10:
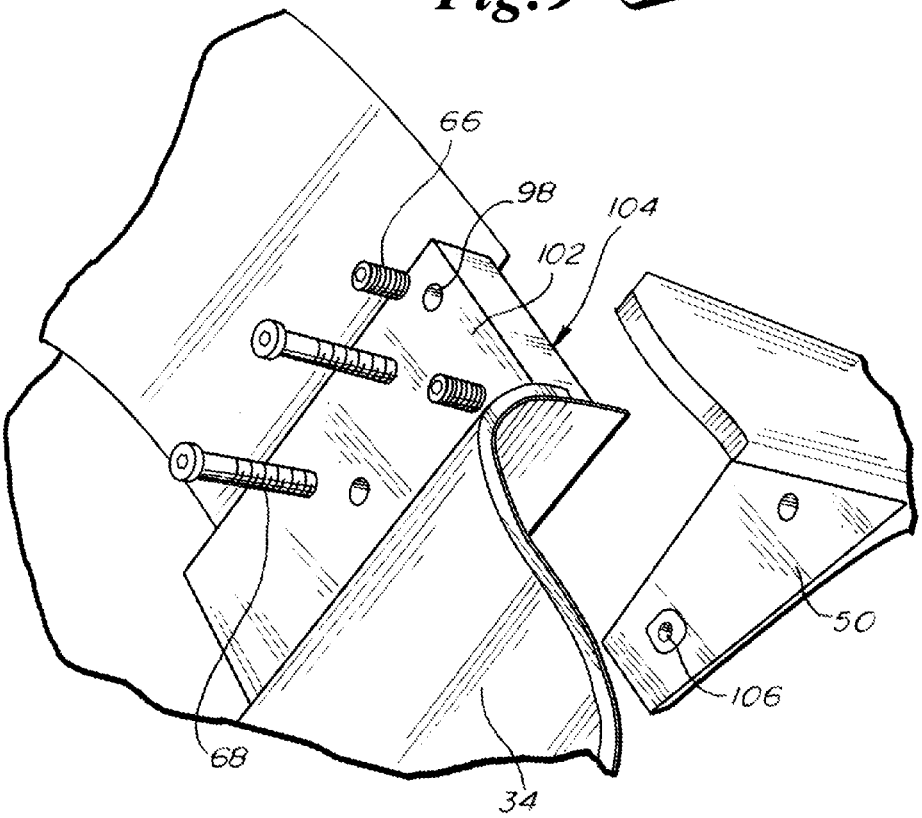
FIG. 10 is a detail exploded isometric view of one alternative embodiment of a neck mounting area and heel of a stringed musical instrument.

At least one embodiment with reference to FIGS. 2 and 3, the affixation/adjustment apertures 98 for receipt of the adjustment screws 66 are threaded. The adjustment screws 66 are aligned to contact adjustment screw stops 100 or interface points, which in some embodiments may be metallic or other materials. In some embodiments the adjustment screw stops 100 resemble the heads of a lug or rivet. In some embodiments the adjustment screw stops 100 are either integral with, or are affixed directly to, the neck mounting area 64 of the side wall 34, and in other embodiments are integral with or affixed directly to a heal block 102 as engaged to the sidewalls 34 of a stringed musical instrument. In some embodiments the adjustment screw stops 100 are recessed relative to the neck mounting area 64, side wall 34, and/or heal block 102. In some embodiments a relieved or recessed area 104 may be present proximate to the neck mounting area 64 forming a recessed pocket for receipt of the heel 50. The relieved or recessed area 104 of the neck mounting area 64 facilitates the positioning and alignment of the neck 60 relative to the sound box 12 during assembly of the stringed musical instrument. (FIG. 10) in at least one embodiment the heel 50 includes a spherical pivot area 106 which is aligned for positioning proximate to the spherical pivot 94.

In at least one embodiment, an injection molded carbon fiber bridge 62 is provided which includes pockets 80 positioned proximate to the soundboard 22 to minimize mass of the bridge 62 and to reduce bond-line stresses on the soundboard 22 following assembly of the stringed musical instrument.

In at least one embodiment, the bridge 62 and pockets 80 improve the acoustic response for the sound box 12 by reducing the mass of the bridge 62. In at least one embodiment, the volume of the sound box 12 is improved because the responsiveness of the soundboard 22 is increased as a result of a reduced mass for the bridge 62, which in turn enhances the amplitude of the vibration of the soundboard 22 for a given string excitation as earlier described. In at least one embodiment a reduction in the mass of the bridge 62, decreases resistance of the soundboard 22 to vibration, which preserves vibrational energy facilitating soundboard vibration and increasing the volume for stringed musical instrument. In at least one embodiment, enhanced vibration of the soundboard 22 increases the sustain of the musical instrument by reducing the energy required in order to vibrate the soundboard 22 for a given amplitude. In at least one embodiment a reduction in the mass of the bridge 62 decreases the energy loss on each vibration cycle, because a lower mass is required to be moved during each vibration cycle. In at least one embodiment, a reduction in the mass of the bridge 62 resulting from the inclusion of pockets 80 reduces bridge 62 stiffness, allowing more flexure of the soundboard 22 enhancing amplitude vibration and thereby increasing the volume of the response of the sound box 12.

In some embodiments, the inclusion of pockets 80 in the bridge 62 provides additional peripheral surfaces around the pockets 80 on the bottom of the bridge 62, which may receive adhesives and/or other bonding agents to secure the bridge 62 to the soundboard 22. The additional peripheral bombing surfaces in some embodiments will reduce peak bond line shear stresses, which in turn will decrease the potential for bond line failure following engagement of the bridge 62 to the soundboard 22. In some embodiments bond line shear stress will be exposed to the interface between the bridge 62 and the soundboard 22 where the bond line shear stresses are primarily located near the edges of the bridge 62. In at least one embodiment, the use of a bridge 62 including pockets 80 will reduce the maximum shear stress by increasing the number of bond line edges used for engagement between the bridge 62 and the soundboard 22.

In at least one embodiment, a composite lamination manufacturing process incorporating either dry or pre-impregnated reinforcements is utilized in the formation of the bridge 62.

In at least one embodiment, the inclusion of pockets 80 on the underside of the bridge 62 has minimal impact on the strength of the bond between the bridge 62 and the soundboard 22, because the majority of the bond stress for retention of the bridge 62 on the soundboard 22 occurs proximate to the exterior peripheral edges of the underside of the bridge 62. In at least one embodiment, the adhesive or bonding agent disposed on the underside of the bridge 62 is not primarily located in regions which are removed from the underside of the bridge 62 to form the pockets 80. In at least one embodiment, the regions of the underside of the bridge 62 used to form the pockets 80 do not carry an appreciable amount of the bonding load between the bridge 62 and the soundboard 22, therefore, the removal of material from the underside of the bridge 62 to form the pockets 80 does not adversely affect the strength of the bond between the bridge 62 and the soundboard 22.

Figure 7:
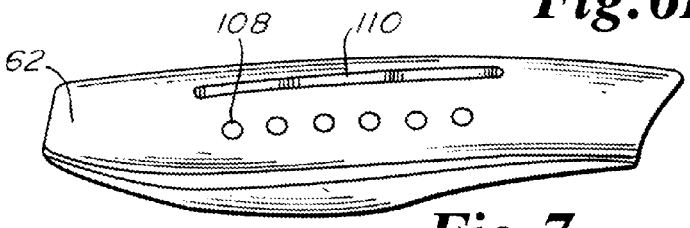
FIG. 7 is a detail perspective view of the top of a bridge of one alternative embodiment of a stringed musical instrument.
Figure 8:
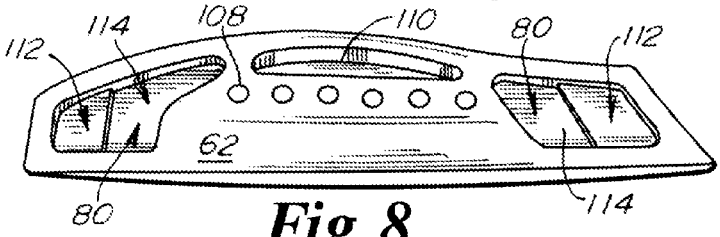
FIG. 8 is a detail perspective view of the bottom of a bridge of one alternative embodiment of a stringed musical instrument.

In at least one embodiment as shown in FIGS. 7 and 8, a bridge 62 is shown. As depicted in FIG. 7 the bridge 62 includes in at least one embodiment a curved upper surface having a plurality of apertures 108 which are constructed and arranged to receive and secure the ends of the strings of a stringed musical instrument. The bridge 62 also includes a slot 110 which is constructed and arranged to receive a saddle used to engage the strings of a musical instrument. In some embodiments, the bridge 62 has a shape and is designed to enhance the acoustic performance and/or response for a stringed musical instrument. In alternative embodiments, the bridge 62 has any shape for the surface as desired.

In at least one embodiment, as depicted in FIG. 8 the underside of the bridge 62 includes a plurality of pockets 80. In some embodiments at least two pockets 80 are provided on the lower surface of the bridge 62. In alternative embodiments, more or less than two pockets 80 may be Incorporated into the lower surface of the bridge 62. In one embodiment, pockets 80 are disposed proximate to opposite ends of the bridge 62. In at least one embodiment, the pockets 80 are of a regular shape and/or are identical in shape. In other embodiments, the pockets 80 are not of a regular shape and/or are not identical in shape. In at least one embodiment, at least one pocket 80 has a first level 112 and a second level 114. In at least one embodiment, the second level 114 may have a greater depth as compared to the first level 112.

In alternative embodiments, pockets 80 may be of any desired shape and may include any desired number of levels in order to provide a desired acoustic response and vibration transfer properties from the strings of a musical instrument to the soundboard 22. In at least one embodiment, the number, size, and shape of the pockets 80 and the number of levels 112, 114 within each pocket 80 may vary to provide a desired acoustic response for a stringed musical instrument.

In at least one embodiment, the bridge 62 is formed by an injection molding manufacturing process. In some alternative embodiments the bridge 62 is formed of carbon fiber, or other suitable fibers which may be selected to provide a desired tonal quality or acoustic response for the sound box 12. In other embodiments, the bridge 62 may be formed of other manufacturing techniques including lamination or a combination of molding and lamination techniques. In other embodiments, the bridge 62 may be formed of other suitable materials as identified herein.

In some embodiments, the underside of the bridge 62 may include one, two, three, four, five, or six or more identical pockets 80, or pockets 80 of different shape. In alternative embodiments, two or more pockets may be joined together into a larger pocket 80, or may otherwise be suitably connected to each other in an overlap configuration, or joined through the use of troughs or channels. In some embodiments, each pocket 80 may include one, two, three, four, five or six or more individual levels. In some embodiments, each of the pockets 80 may be of any desired shape or size. In such embodiments, two or more levels may be joined together into the formation of a multiple tiered pocket having ascending or descending depth, or a combination of ascending and descending depth, in a regular shape or irregular shape. In some embodiments, the pockets 80 are formed by a machining/removal process. In alternative embodiments, the pockets 80 are closed cavities which do not traverse or breach the exterior wall or periphery of the bridge 62. In some embodiments, any of the above identified elements or features for the bridge 62 and/or pockets 80 may be combined in any combination.

Bridge adjustment is usually accomplished in a trial an error process of (a) stringing the instrument to playing tension, (b) measuring string height, (c) removing the bridge (or a removable saddle that sits in the bridge), (d) sanding or trimming saddle to shape, (e) restringing, and (f) repeating as necessary to accomplish proper string adjustment relative to the neck 60 and soundboard 12.

In at least one embodiment, a method is provided for mounting a stringed instrument to a body including the provision of a neck which allows for two way neck to body adjustment, namely in a vertical direction as well as a horizontal direction, by means of two adjustable screws.

In at least one embodiment mounting is accomplished through the use of mounting and attachment bolts which are inserted from the neck side into the body side and body of the stringed instrument. In an alternative embodiment the mounting and attachment bolts are inserted from the inside the body outwardly and into the neck. In at least one embodiment metal threaded inserts are used to disperse force and prevent local damage from mounting and adjustment of the mounting and attachment bolts or screws during the attachment of the neck to the sound box.

In at least one embodiment both the guitar body and the guitar neck are made primarily of composite materials, including those reinforced with carbon, glass, or aramid fibers and combinations thereof.

In at least one embodiment a musical instrument neck is provided the neck being comprised of: a fiber reinforced compression or injection molded hollow neck section with an integral headstock section and heel section; a fiber reinforced injection molded fingerboard with a molded pocket is provided for receipt of a carbon fiber insert; alternatively two carbon fiber inserts are provided, one located in the fret board and one in the neck, for the purpose of adding stiffness and stability to the neck assembly; heel insert(s) either in the form of a solid metal bar or threaded metal inserts for receiving the mounting bolts; a headstock veneer that may act as a structural member and/or a decorative cover; and an injection molded fiber reinforced headstock insert that supports the headstock and veneer, such that tuning keys may be installed into the headstock that also have self-locating features to fit the neck and headstock veneer, and any combinations of the above elements.

In at least one embodiment a musical instrument fingerboard is provided that has been designed and reinforced to act both as a playing surface and as a structural member. In at least one embodiment the fingerboard is comprised of an outer material to provide a suitable playing surface and to accept frets (if used) and an inner material to provide structural stiffness comprised of a stiff, fiber reinforced resin or plastic or combinations thereof.

In at least one embodiment a fiber reinforced injection or compression molded guitar bridge is provided where material has been removed from the underside of the bridge to create pockets on the underside of the bridge. In at least one embodiment the pockets are created in areas of low stress within the bridge. In at least one embodiment the bridge is formed primarily of carbon fiber and a thermoplastic materials, such as polyphenylene sulfide, polethersulfone, polyetheretherketone, thermoplastic polyurethane, or a thermosetting resin, such as epoxy or polyester and combinations thereof. In at least one embodiment the bridge is formed by injection molding, and the pockets are molded into the bridge. In at least one alternative embodiment the pockets are machined after molding of the bridge has occurred.

In at least one embodiment a soundboard for a musical instrument is provided wherein the soundboard is formed by forming a bracing structure comprising at least one bracing element; and attaching the bracing structure to a soundboard. In at least one embodiment the attaching of the bracing structure to the soundboard occurs through bonding or through the use of adhesives. In at least one embodiment the bracing structure includes at least one structural element. In at least one embodiment the bracing structure includes a plurality of structural elements which may be formed into a pattern or other irregular configuration.

In at least one embodiment the height of the at least one structural element varies along the length of the at least one structural element. In at least one embodiment the width of the at least one structural element varies along the length of the at least one structural element. In at least one embodiment both the height and the width of the at least one structural element varies along the length of the at least one structural element. In at least one embodiment the at least one structural element has the features and functions as disclosed in U.S. Pat. No. 8,450,587 which is incorporated by reference herein in its entirety.

In at least one embodiment a stringed musical instrument is provided, the stringed musical instrument comprising: an injection molded body formed of plastic, or plastic and carbon fibers; a soundboard, the soundboard being at least partially formed of carbon fibers; a bracing structure, the bracing structure being formed at least partially with carbon fibers, the bracing structure being bonded to the soundboard, and the soundboard being bonded to the body; a bridge bonded to the soundboard, the bridge defining a hollow chamber between the bridge and the soundboard, the bridge and the bracing structure being on opposite faces of the soundboard; an injection molded neck formed of plastic, or plastic and carbon fibers, the neck being elongate in a longitudinal direction, the neck including an integral head, the neck defining a hollow cavity extending into the integral head; a neck insert formed at least partially of carbon fibers, at least a portion of the carbon fibers being oriented in the longitudinal direction, the neck insert being installed within the hollow cavity of the neck, the neck insert being bonded to the neck; a fret board insert being formed at least partially of carbon fibers, at least a portion of the carbon fibers being oriented in the longitudinal direction, the fret board insert being installed within the hollow cavity of the neck, the fret board insert and the neck insert defining a gap therebetween, the fret board insert being bonded to the neck; a fret board overlying the fret board insert, the fret board being bonded to at least one of the fret board insert and the neck; a headstock insert disposed within the headstock, the headstock insert defining a plurality of tuning peg holes, the headstock insert being bonded to the integral head of the headstock; a headstock veneer or another headstock insert overlying the headstock insert, the headstock veneer being bonded to at least one of the headstock insert and the integral head of the neck; and a pivotal connection connecting the neck to the body, the pivotal connection comprising a spherical member between the neck and the body, a heal insert, and a plurality of adjustment screws, the heal insert being comprised of metal and being disposed within the neck and any combinations of the above identified elements.

In at least one embodiment a sound box for a stringed musical instrument is provided the sound box being molded using heat and pressure; the sound box being formed from a material containing 20% to 60% discontinuous carbon fiber dispersed in a polymeric matrix; wherein the sound box has integrally molded features, including but not necessarily limited to ribs, struts, or bosses which function to provide structural reinforcement for controlling instrument tone; reacting structural loads from the strings; providing means of attaching a soundboard; and/or providing for attachment of an instrument neck and combinations of the above elements and features.

In at least one embodiment the sound box is formed by forcing melted plastic contain carbon fiber through an opening into a closed cavity defining the internal and external surfaces of the sound box, where the plastic cools to make a solid instrument sound box. In at least one embodiment a sound box is formed by forcing liquid resin contain carbon fiber through an opening into a closed cavity defining the internal and external surfaces of the sound box, where the resin undergoes a chemical reaction to solidify and to form a rigid instrument sound box. In at least one embodiment a sound box is formed by applying heat and/or pressure through a penetrating and receiving mold or die containing a material comprising a mixture of carbon fiber and resin, which causes the material to flow and to form into the shape of the mold or die. In at least one embodiment the molds utilized to form the sound box are textured in order to provide a desirable cosmetic finish for the stringed musical instrument. In at least one embodiment the inside of the sound box is textured, or has another surface pattern, such as dimples or sine waves, which in turn scatter generated sound waves and minimize the occurrence of standing waves during use of a stringed musical instrument.

In an alternative embodiment, the sound box is formed by a combination of the identified manufacturing methods. In at least one embodiment reinforcing ribs or struts are added to the sound box in order to modify various resonances and to change the acoustic response of the stringed musical instrument. In at least one embodiment the sound box is molded with thicker regions in order to provide points of structural attachment of an instrument neck or a strap for supporting the instrument.

In at least one embodiment polymeric resin or plastic is selected as materials utilized to form the sound box in order to provide both favorable structural and acoustic performance. In at least one embodiment the percentage of carbon fiber which is selected to form the sound box provides both favorable structural and acoustic performance for the stringed musical instrument. In at least one embodiment the polymeric resin or plastic selected to form the sound box, and the type and percentage of carbon fiber which is selected to form the sound box interact together in order to provide both favorable structural and acoustic performance for the stringed musical instrument.

In at least one embodiment the soundboard and/or the bracing structure may include at least one layer of material, the at least one layer of material comprising carbon fibers or other suitable fibers; or at least one layer of fiber laminate; carbon fiber laminate; or composite material laminate or combinations thereof. In at least one embodiment the at least one layer of material may be formed of material selected from the group consisting of resin, carbon fibers, other suitable fibers, a plastic matrix, Nomex fiber in a resin matrix, glass fiber in a resin matrix, paper in a resin matrix, carbon fiber in a resin matrix, polymers such as polypropylene, and polyvinyl chloride and combinations thereof.

In at least one embodiment a stringed musical instrument is provided, the stringed instrument comprising: a plurality of musical strings, each of which has a vibration section for defining a musical tone; a soundboard positioned to interact with the string vibration sections to enhance musical tones produced by vibration of the string sections, the soundboard being made of a plurality of composite materials comprised of carbon fiber, fibrous laminate material and resin or plastic matrix; and a bracing structure attached to the soundboard for the purpose of reacting string tension and/or shaping musical response, with the bracing structure being comprised of carbon fiber or other materials or combinations of materials as identified herein.

In at least one embodiment, a soundboard for a stringed instrument is provided, the soundboard having: a sound hole and an interior surface; and a bracing structure comprising a plurality of elongate bracing elements, each of the bracing elements having a length, a thickness, a width, a height providing resonance response, said bracing structure covering at least a portion of the interior surface of the soundboard.

In at least one embodiment, the bracing structure is formed of a single piece brace which is of the same size or smaller than the soundboard, however the bracing structure includes raised areas or braces in specific locations to provide for both structural support and tone control for the soundboard. In at least one embodiment, the bracing structure includes additional fibrous reinforcement which is added to the raised sections or braces. In at least one embodiment, the bracing structure may include additional plies of material which are added in selected locations to increase strength of the soundboard or improve the tone for the stringed musical instrument.

In at least one embodiment, the bracing structure is formed of a resin, with or without fiber material or a filler where the bracing structure is injection molded into a final shape. In at least one embodiment, the bracing structure is formed of chopped, randomly oriented fibers, such as fiberglass or carbon, and a resin, such as epoxy, which is compression molded into a final shape.

In at least one embodiment, both the guitar body and the guitar neck are made primarily of composite materials, including reinforced carbon or carbon fibers, glass, or aramid fibers or a matrix resin, such as epoxy or polyester and combinations thereof.

In at least one embodiment, the neck includes a curved or spherical pivot interface which is located between the heel and the sound box at a mounting point which is positioned away from the location of the adjustment screws.

In at least one embodiment, metal reinforcement is added to the neck mounting area or the heel attachment block to spread out or disperse the force as generated by the tightening of the adjustment screws in order to prevent local deformation of the sound box at the impingement locations of the adjustment screws.

In at least one embodiment the neck is formed of a hollow neck section having an integral headstock section; a reinforced fingerboard that acts as the upper structural surface of the neck; a heel for mounting the neck to the instrument sound box; a heel block that fits inside the neck to support and facilitate attachment of the heel to the neck; a headstock veneer which functions as both a structural member and as a decorative cover; a lightweight headstock insert which supports the headstock and the veneer such that tuning keys may be installed into the headstock; mechanical fasteners which provide for the attachment of the heel to the neck and for the attachment of the neck to the instrument sound box; and a nut block which supports the instrument nut.

In at least one embodiment the fingerboard is formed of an outer material to provide a suitable playing surface, and to accept frets, as well as inner material to provide structural stiffness, the inner material being formed of a stiff, fiber reinforced resin or plastic.

In at least one embodiment the neck heel, heel attachment block, and/or the nut block are formed of metal, such as aluminum, titanium, magnesium, brass or steel. In at least one embodiment, the neck heel, heel attachment block, and/or the nut block are formed of randomly oriented fiber reinforced resin or plastic. In at least one embodiment the neck is comprised of a composite material consisting of a reinforcing fiber, such as carbon, glass, or aramid, and a matrix resin, such as epoxy or polyester.

In at least one embodiment, the insert for the fingerboard is made from a foam type material with a density from 5 lbs/ft3 to 45 lbs/ft3.

In a first alternative embodiment the invention includes a neck for a stringed musical instrument, said neck comprising:

- a fiber compression or injection molded neck section having a headstock section and a heel section;
- a fiber injection molded fingerboard engaged to said neck section; and
- at least one fiber insert engaged to said fingerboard, said at least insert being constructed and arranged to enhance stiffness and stability of said neck section.

In a second alternative embodiment according to the first embodiment the neck section is hollow and at least one fiber neck insert is disposed in said hollow neck section.

In a third alternative embodiment according to the first embodiment said fingerboard comprises a molded pocket and said at least one fiber insert is disposed in said molded pocket.

In a fourth alternative embodiment according to the first embodiment said at least one fiber insert comprises at least one of carbon fiber, carbon fiber and resin, carbon fiber and plastic, and carbon fiber and resin and plastic.

In a fifth alternative embodiment according to the first embodiment the neck further comprises an injection molded fiber headstock insert engaged to said headstock section and a headstock veneer engaged to said headstock insert.

In a sixth alternative embodiment according to the first embodiment said neck is connected to a sound box comprising a soundboard, a bracing structure, a side wall, and a bottom wall.

In a seventh alternative embodiment according to the sixth embodiment said sound box or said neck are formed composite materials selected from the group consisting of carbon fibers, glass fibers, reinforcing fibers, aramid fibers, and a matrix resin such as epoxy or polyester and combinations thereof.

In an eighth alternative embodiment according to the sixth embodiment the neck further comprises an adjustable attachment mechanism constructed and arranged to adjustably attach said neck to said sound box in a vertical direction and in a horizontal direction.

In a ninth alternative embodiment according to the eighth embodiment said attachment mechanism comprises a pivot positioned between the heel section and the sound box.

In a tenth alternative embodiment according to the sixth embodiment the neck further comprises an injection or compression molded bridge engaged to said soundboard, said bridge comprising a lower side comprising a plurality of pockets.

In an eleventh alternative embodiment according to the tenth embodiment said bridge is formed composite materials selected from the group consisting of carbon fiber, thermoplastic materials, polyphenylene sulfide, polethersulfone, polyetheretherketone, thermoplastic polyurethane, and a thermosetting resin such as epoxy or polyester and combinations thereof.

In a twelfth alternative embodiment according to the sixth embodiment said bracing structure is molded and is formed of materials selected from the group consisting of woven fibrous materials, woven fibrous carbon, woven fibrous fiberglass, chopped fibers, randomly oriented fibers, and a binder resin such as epoxy, and combinations thereof.

In a thirteenth alternative embodiment a sound box for a stringed musical instrument is disclosed, said sound box comprising:

a molded side wall comprising carbon fibers;

a soundboard comprising carbon fibers engaged to said side wall;

a molded bracing structure comprising a plurality of braces, said bracing structure further comprising carbon fibers, said bracing structure being bonded to the soundboard; and a bottom board comprising carbon fibers engaged to said side wall opposite to said soundboard.

In a fourteenth alternative embodiment according to the thirteenth embodiment said sound box further comprises a molded bridge bonded to the soundboard, the bridge comprising at least one pocket disposed proximate to said soundboard.

In a fifteenth alternative embodiment according to the fourteenth embodiment said sound box further comprises a molded neck comprising carbon fibers, said neck being engaged to said side wall proximate to said soundboard.

In a sixteenth alternative embodiment according to the thirteenth embodiment said sound box comprises 20% to 60% carbon fiber.

In a seventeenth alternative embodiment according to the sixteenth embodiment said carbon fiber is disposed in a polymeric matrix.

In an eighteenth alternative embodiment according to the thirteenth embodiment said sound box further comprises at least one of carbon fiber, carbon fiber and resin, carbon fiber and plastic, and carbon fiber and resin and plastic, wherein said carbon fiber, said carbon fiber and said resin, said carbon fiber and said plastic, and said carbon fiber and said resin and said plastic are constructed and arranged to enhance structural performance and acoustic performance of said sound box.

In a nineteenth alternative embodiment according to the fifteenth embodiment said neck includes a hollow portion and at least one fiber neck insert is disposed in said hollow portion.

In a twentieth alternative embodiment according to the fifteenth embodiment said neck further comprises a fingerboard comprising a molded pocket and at least one fiber insert is disposed in said molded pocket.

In a twenty-first alternative embodiment according to the fifteenth embodiment said neck further comprises a headstock section, an injection molded fiber headstock insert is engaged to said headstock section, and a headstock veneer is engaged to said headstock insert.

In a twenty-second alternative embodiment according to the fifteenth embodiment said neck further comprises a heel section, and an adjustable attachment mechanism comprising a pivot positioned between the heel section and the sound box, said attachment mechanism being constructed and arranged to adjustably attach said neck to said sound box in a vertical direction and in a horizontal direction.

In a twenty-third alternative embodiment according to the fourteenth embodiment said bridge is formed by an injection or compression molding process.

In a twenty-fourth alternative embodiment a bridge for a stringed musical instrument is disclosed, said bridge comprising:

an injection or compression molded bridge body, said bridge body comprising a lower side comprising a plurality of pockets.

In a twenty-fifth alternative embodiment according to the twenty-fourth embodiment said bridge comprises opposite ends, wherein at least one of said plurality of pockets is disposed proximate to one of said opposite ends.

In a twenty-sixth alternative embodiment according to the twenty-fourth embodiment said plurality of pockets are of a regular shape.

In a twenty-seventh alternative embodiment according to the twenty-fourth embodiment at least two of said plurality of pockets are identical in shape.

In a twenty-eighth alternative embodiment according to the twenty-fourth embodiment at one of said plurality of pockets has a first level and a second level, said first level having a different depth dimension as compared to said second level.

In a twenty-ninth alternative embodiment according to the twenty-fourth embodiment said bridge is engaged to a soundboard.

In a thirtieth alternative embodiment according to the twenty-fourth embodiment said bridge is formed composite materials selected from the group consisting of carbon fiber, thermoplastic materials, polyphenylene sulfide, polethersulfone, polyetheretherketone, thermoplastic polyurethane, and a thermosetting resin such as epoxy or polyester and combinations thereof.

In a thirty-first alternative embodiment the invention includes a neck for a stringed musical instrument, said neck comprising:

a fiber compression or injection molded neck section, said neck section having a hollow portion and at least one fiber neck insert is disposed in said hollow portion.

In a thirty-second alternative embodiment according to the thirty-first embodiment said neck section further comprises a fiber injection molded fingerboard engaged to said neck section and at least one fiber insert is engaged to said fingerboard, said at least insert being constructed and arranged to enhance stiffness and stability of said neck section.

In a thirty-third alternative embodiment according to the thirty-second embodiment said fingerboard comprises a molded pocket and said at least one fiber insert is disposed in said molded pocket.

In a thirty-fourth alternative embodiment according to the thirty-first embodiment the neck section further comprises a headstock section and a heel section.

In a thirty-fifth alternative embodiment a neck for a stringed musical instrument, said neck comprising:

a fiber compression or injection molded neck section having a headstock section and a heel section;

a fiber injection molded fingerboard engaged to said neck section; and at least one fiber insert engaged to said fingerboard, said at least insert being constructed and arranged to enhance stiffness and stability of said neck section.

In a thirty-sixth alternative embodiment according to the thirty-fifth alternative embodiment said neck section is hollow and at least one fiber neck insert is disposed in said hollow neck section.

In a thirty-seventh alternative embodiment according to the thirty-fifth alternative embodiment said fingerboard comprising a molded pocket and said at least one fiber insert is disposed in said molded pocket.

In a thirty-eighth alternative embodiment according to the thirty-fifth alternative embodiment said neck is connected to a sound box comprising a soundboard, a bracing structure, a side wall, and a bottom wall.

In a thirty-ninth alternative embodiment according to the thirty-eighth alternative embodiment the neck further comprises an adjustable attachment mechanism constructed and arranged to adjustably attach said neck to said sound box in a vertical direction and in a horizontal direction.

In a fortieth alternative embodiment according to the thirty-ninth alternative embodiment said attachment mechanism comprises a pivot positioned between the heel section and the sound box.

In a forty-first alternative embodiment according to the thirty-eighth alternative embodiment the neck further comprises an injection or compression molded bridge engaged to said soundboard, said bridge comprising a lower side comprising a plurality of pockets.

In a forty-second alternative embodiment a sound box for a stringed musical instrument is disclosed, said sound box comprising:

a molded side wall comprising carbon fibers;

a soundboard comprising carbon fibers engaged to said side wall;

a molded bracing structure comprising a plurality of braces, said bracing structure further comprising carbon fibers, said bracing structure being bonded to the soundboard; and a bottom board comprising carbon fibers engaged to said side wall opposite to said soundboard.

In a forty-third alternative embodiment according to the forty-second alternative embodiment said sound box further comprises a molded bridge bonded to the soundboard, the bridge comprising at least one pocket disposed proximate to said soundboard.

In a forty-fourth alternative embodiment according to the forty-second alternative embodiment said sound box further comprises a molded neck comprising carbon fibers, said neck being engaged to said side wall proximate to said soundboard.

In a forty-fifth alternative embodiment according to the forty-second alternative embodiment said sound box comprises 20% to 60% carbon fiber.

In a forty-sixth alternative embodiment according to the forty-fourth alternative embodiment said neck includes a hollow portion and at least one fiber neck insert is disposed in said hollow portion.

In a forty-seventh alternative embodiment according to the forty-fourth alternative embodiment said neck further comprises a fingerboard comprising a molded pocket and at least one fiber insert is disposed in said molded pocket.

In a forty-eighth alternative embodiment according to the forty-fourth alternative embodiment, said neck further comprises a heel section, and an adjustable attachment mechanism comprising a pivot positioned between the heel section and the sound box, said attachment mechanism being constructed and arranged to adjustably attach said neck to said sound box in a vertical direction and in a horizontal direction.

In a forty-ninth alternative embodiment according to the forty-third alternative embodiment said bridge is formed by an injection or compression molding process.

In a fiftieth alternative a bridge for a stringed musical instrument is disclosed, said bridge comprising:

an injection or compression molded bridge body, said bridge body comprising a lower side comprising a plurality of pockets.

In a fifty-first alternative embodiment according to the fiftieth alternative embodiment said bridge comprises opposite ends, wherein at least one of said plurality of pockets is disposed proximate to one of said opposite ends.

In a fifty-second alternative embodiment according to the fiftieth alternative embodiment said plurality of pockets are of a regular shape.

In a fifty-third alternative embodiment according to the fiftieth alternative embodiment at least two of said plurality of pockets are identical in shape.

In a fifty-fourth alternative embodiment according to the fiftieth alternative embodiment at least one of said plurality of pockets has a first level and a second level, said first level having a different depth dimension as compared to said second level.

Other documents and features incorporated in this application include U.S. Pat. No. 6,060,650, U.S. application Ser. No. 09/852,253 and U.S. application Ser. No. 09/567,145.

In addition to being directed to the embodiments described above and claimed below, the present invention is further directed to embodiments having different combinations of the dependent features described above and/or claimed below. Every patent, application or publication mentioned above is herein incorporated by reference.

The invention contemplates any combination of the above described elements of the stringed instrument. Therefore, it should be understood that multiple inventions are disclosed herein.

The above examples and disclosure are intended to be illustrative and not exhaustive. These examples and description will suggest many variations and alternatives to one of ordinary skill in this art. Further, the particular features presented in the dependent claims can be combined with each other in other manners within the scope of the invention such that the invention should be recognized as also specifically directed to other embodiments having any other possible combination of the features of the dependent claims.

This completes the description of the alternate embodiments of the invention. Those skilled in the art may recognize other equivalents to the specific embodiment described herein which equivalents are intended to be encompassed by the claims attached hereto.

I claim:

1. A neck for a stringed musical instrument, said neck comprising:

a fiber compression or injection molded neck section having a headstock section and a heel section;

a fiber injection molded fingerboard engaged to said neck section, said fingerboard comprising a molded pocket; and at least one fiber insert engaged to said fingerboard and disposed in said molded pocket, said at least insert being constructed and arranged to enhance stiffness and stability of said neck section.

2. The neck according to claim 1, wherein said neck section is hollow and at least one fiber neck insert is disposed in said hollow neck section.

3. The neck according to claim 1, wherein said neck is connected to a sound box comprising a soundboard, a bracing structure, a side wall, and a bottom wall.

4. The neck according to claim 3, further comprising an injection or compression molded bridge engaged to said soundboard, said bridge comprising a lower side comprising a plurality of pockets.

5. The neck according to claim 1, said at least one fiber insert comprising carbon fiber.

6. The neck according to claim 1, said fiber injection molded fingerboard comprising a first side and an opposed second side, the second side contacting said at least one fiber insert, said first side comprising frets.

7. A neck for a stringed musical instrument, said neck comprising:

a fiber compression or injection molded neck section having a headstock section and a heel section;

a fiber injection molded fingerboard engaged to said neck section; and at least one fiber insert engaged to said fingerboard, said at least insert being constructed and arranged to enhance stiffness and stability of said neck section;

wherein said neck is connected to a sound box comprising a soundboard, a bracing structure, a side wall, and a bottom wall;

further comprising an adjustable attachment mechanism constructed and arranged to adjustably attach said neck to said sound box in a vertical direction and in a horizontal direction.

8. The neck according to claim 7, said attachment mechanism comprising a pivot positioned between the heel section and the sound box.

9. The neck according to claim 7, said adjustable attachment mechanism comprising a first fastener arranged to provide adjustment about a first axis.

10. The neck according to claim 9, said adjustable attachment mechanism comprising a first adjustment screw arranged to provide adjustment about a second axis, the second axis orthogonal to the first axis.

11. The neck according to claim 10, said adjustable attachment mechanism comprising a second fastener, said first fastener and said second fastener aligned upon said second axis.

12. The neck according to claim 10, said adjustable attachment mechanism comprising a second adjustment screw, said first adjustment screw and said second adjustment screw oriented on opposite sides of the second axis.

13. A neck assembly for a stringed musical instrument, said neck assembly comprising:

a neck section comprising a headstock and a heel;

a fingerboard engaged to said neck section, said fingerboard comprising a pocket; and a stiffening fiber insert positioned in said pocket and engaged to said fingerboard.

14. The neck assembly of claim 13, said stiffening fiber insert comprising carbon fiber.

15. The neck assembly of claim 13, said fingerboard comprising a first side and an opposed second side, the second side contacting said stiffening fiber insert, said first side comprising frets.

16. The neck assembly of claim 13, the neck section comprising a cavity and a neck stiffener oriented in the cavity.

17. The neck assembly of claim 13, said headstock comprising a cavity and a fiber-reinforced headstock insert oriented in the cavity.

18. The neck assembly of claim 17, said headstock comprising a headstock veneer.

19. The neck assembly of claim 13, arranged for attachment to a soundbox and comprising adjustable attachment mechanism comprising a pivoting mount and a fastener.

20. The neck assembly of claim 13, arranged for attachment to a soundbox and comprising adjustable attachment mechanism comprising a fastener arranged to provide adjustment about a first axis and an adjustment screw arranged to provide adjustment about a second axis, the second axis orthogonal to the first axis.

* * * * *